United States Patent [19]

Sassmannshausen

[11] 4,213,171

[45] Jul. 15, 1980

[54] LIGHTING FIXTURE WITH SIDE ESCAPE WINDOW

[76] Inventor: Knut O. Sassmannshausen, Wexford, Ireland

[21] Appl. No.: 808,726

[22] Filed: Jun. 21, 1977

[30] Foreign Application Priority Data

| | | | |
|---|---|---|---|
| Jun. 24, 1976 | [DE] | Fed. Rep. of Germany | 2628243 |
| Oct. 18, 1976 | [DE] | Fed. Rep. of Germany | 2646930 |
| Jan. 31, 1977 | [AT] | Austria | 11586/77 |
| Apr. 29, 1977 | [IE] | Ireland | 865/77 |

[51] Int. Cl.[2] ..... F21V 7/00

[52] U.S. Cl. ..... 362/310; 362/64; 362/72; 362/336; 362/347; 362/350

[58] Field of Search ..... 362/29, 61, 64, 72, 362/299, 300, 4, 5, 310, 328, 329, 336, 337, 346, 347, 350

[56] References Cited

U.S. PATENT DOCUMENTS

| | | | |
|---|---|---|---|
| 1,676,464 | 7/1928 | Ryan | 362/336 X |
| 1,764,474 | 6/1930 | Shippee | 362/61 X |
| 1,964,325 | 6/1934 | Lebby | 362/336 X |
| 1,992,041 | 2/1935 | Roper et al. | 362/350 X |
| 2,006,249 | 6/1935 | Rall | 362/61 |
| 2,058,707 | 10/1936 | McGregor | 362/335 |
| 2,216,965 | 10/1940 | Sukumlyn | 362/335 X |
| 2,224,178 | 12/1940 | Bitner | 362/337 |
| 2,254,961 | 9/1941 | Harris | 362/336 X |
| 2,279,103 | 4/1942 | Anklam | 362/61 X |
| 2,352,801 | 7/1944 | Rolph | 362/337 X |
| 3,110,883 | 11/1963 | Nallinger et al. | 362/64 X |
| 3,184,592 | 5/1965 | Cibie | 362/346 X |
| 4,115,843 | 9/1978 | Nagel | 362/337 X |

*Primary Examiner*—Peter A. Nelson

*Attorney, Agent, or Firm*—Herbert L. Lerner

[57] ABSTRACT

Lighting fixture includes an enclosure. Disposed in the enclosure are means for supplying a source of light at a light center therein. Also disposed in the enclosure are means for directing a beam of light out of the enclosure from the source along a given optical axis. Furthermore, disposed at least at one side of the optical axis and in a common horizonal plane with the light center are means for directing part of the light from the source out of the enclosure.

50 Claims, 56 Drawing Figures

FIG. 1
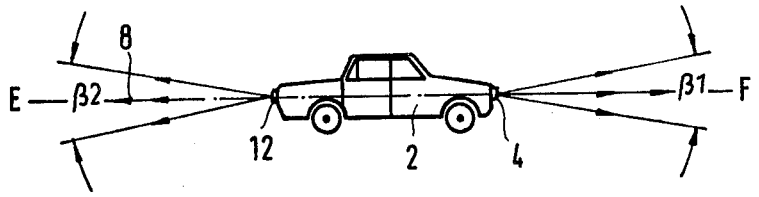
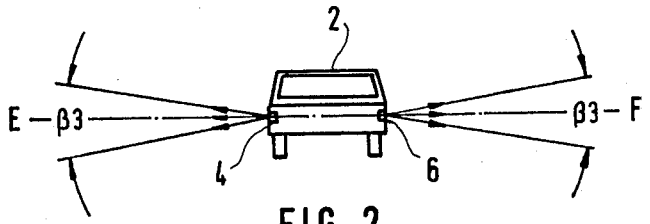
FIG. 2
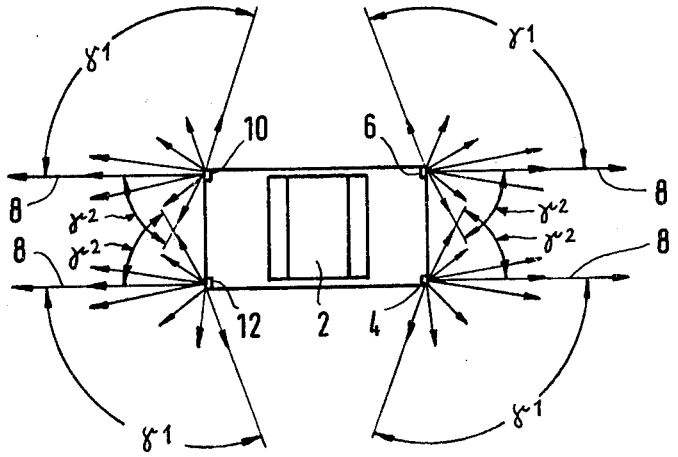
FIG. 3

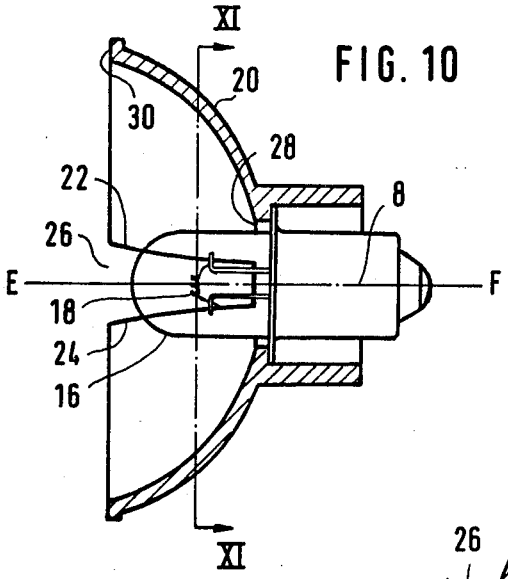
FIG. 10
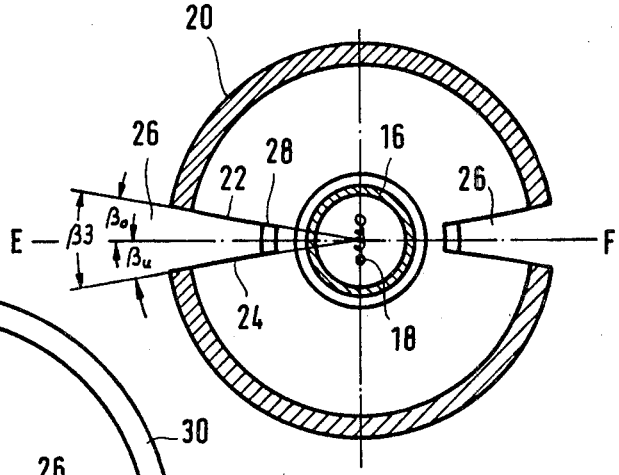
FIG. 11
FIG. 12
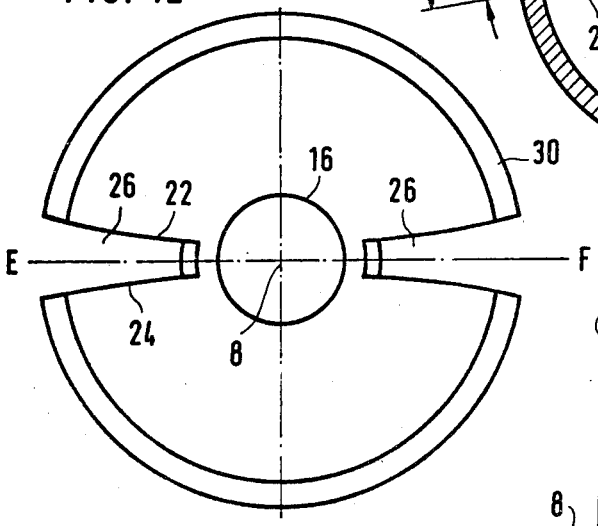
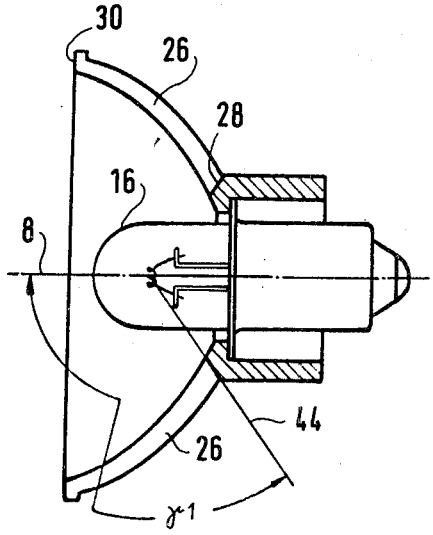
FIG. 13

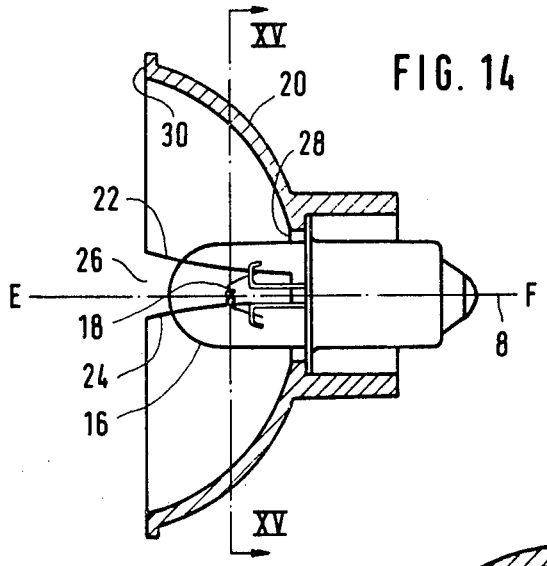
FIG. 14
FIG. 15
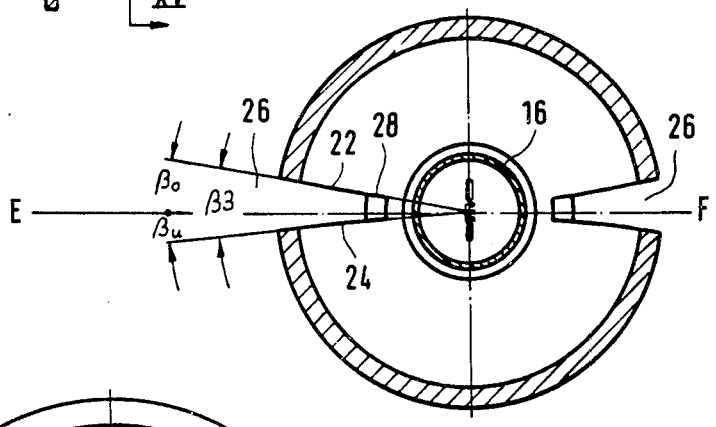
FIG. 16
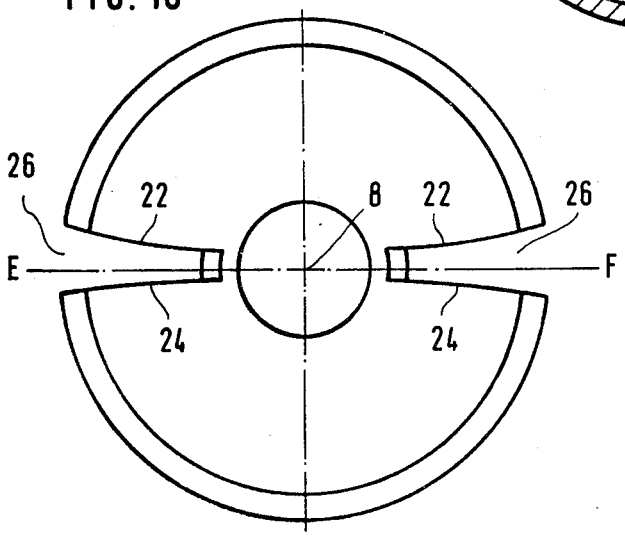

FIG. 28
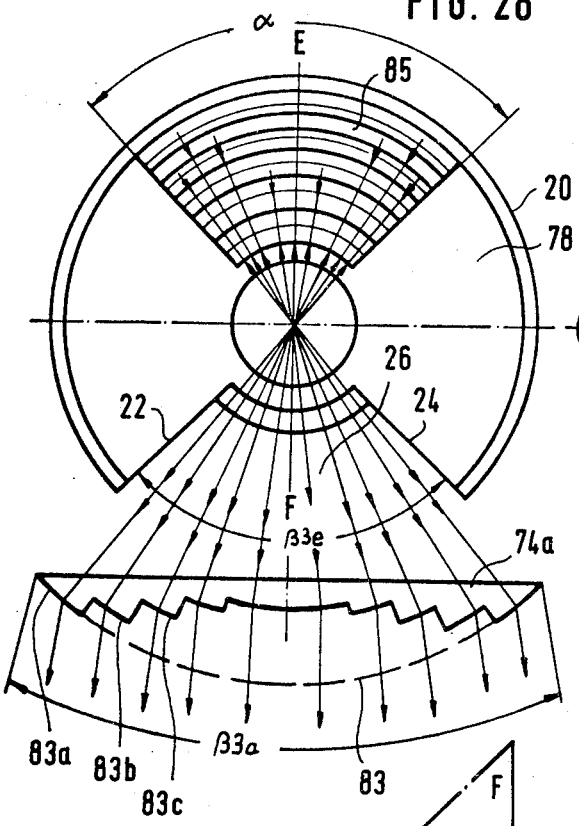
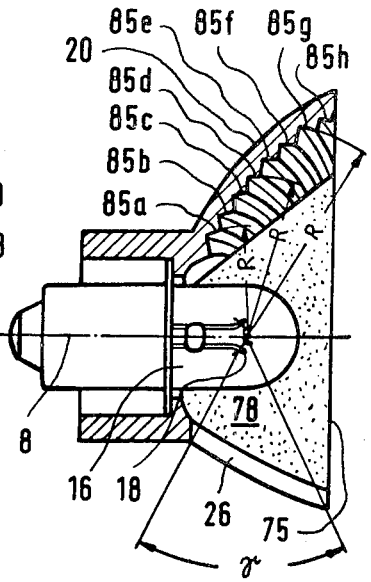
FIG. 29
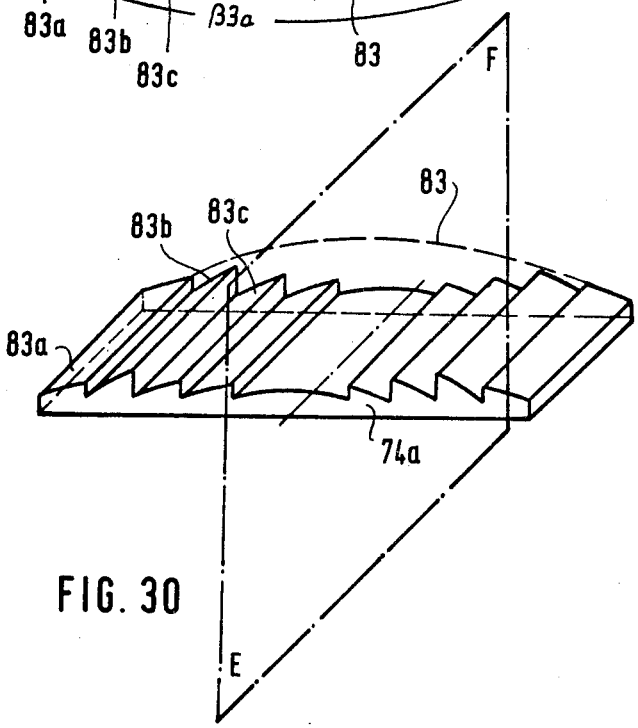
FIG. 30
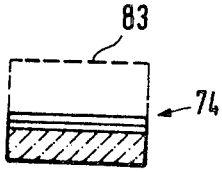
FIG. 31

FIG. 32
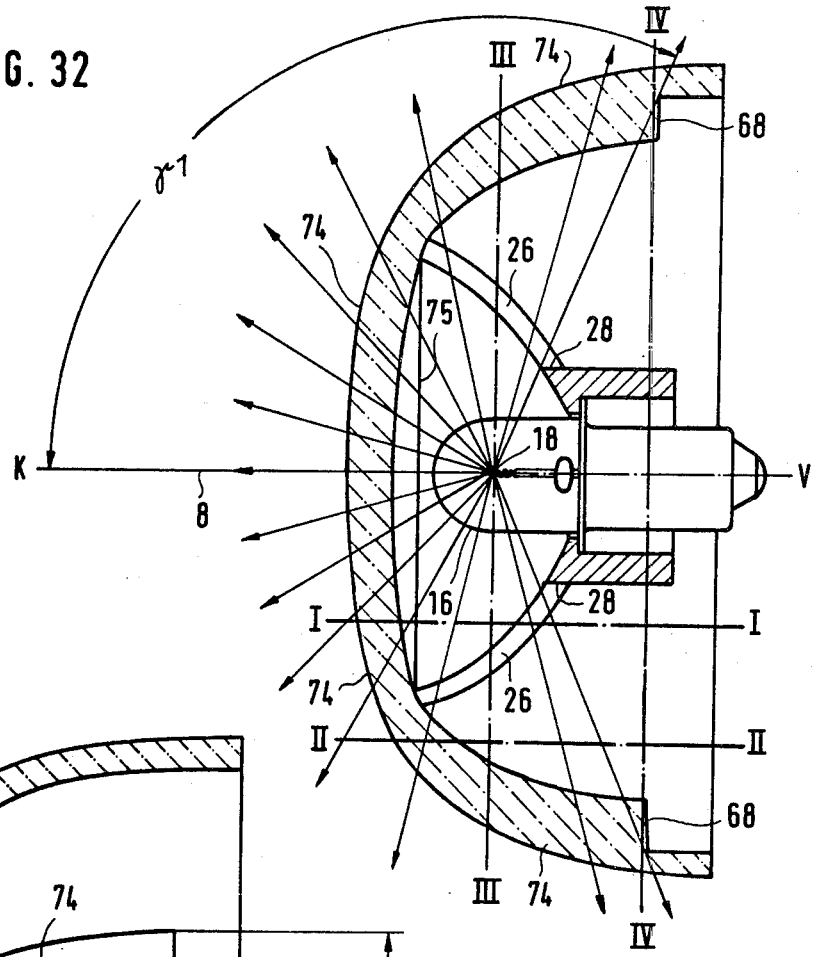
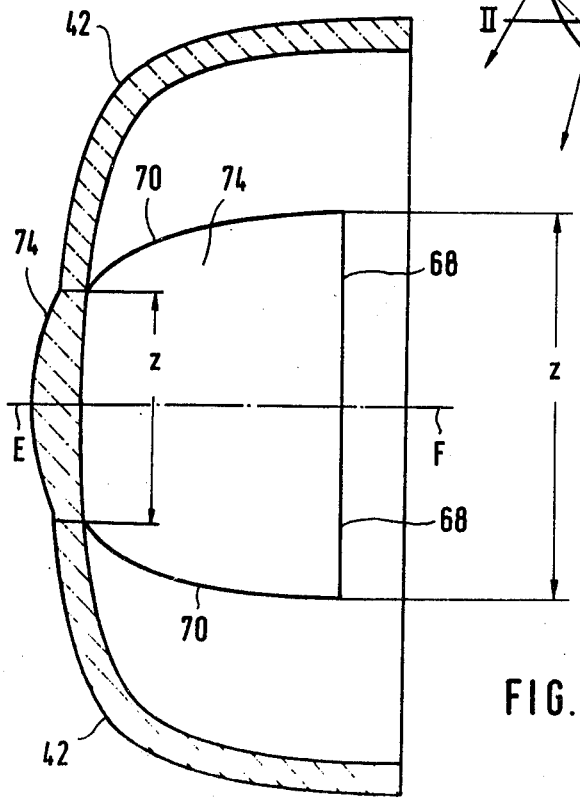
FIG. 34

FIG. 33
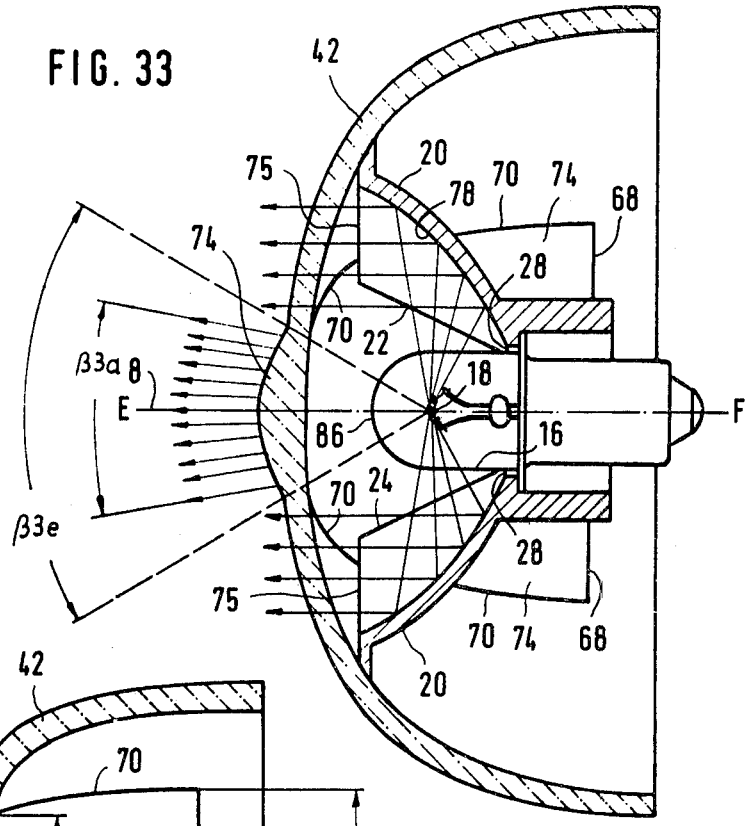
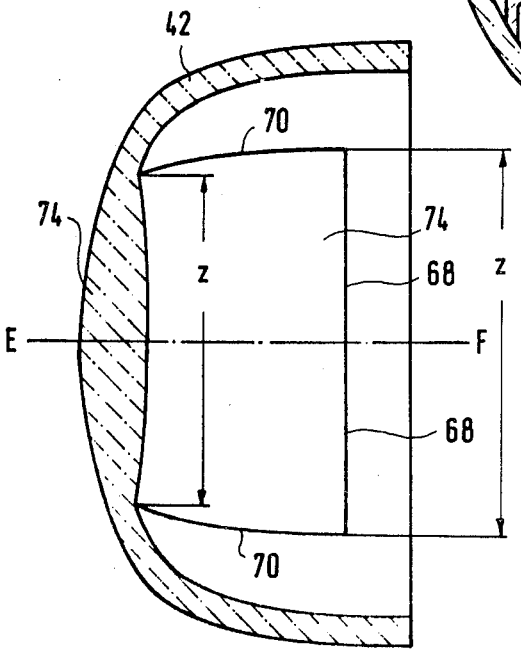
FIG. 35

FIG. 36
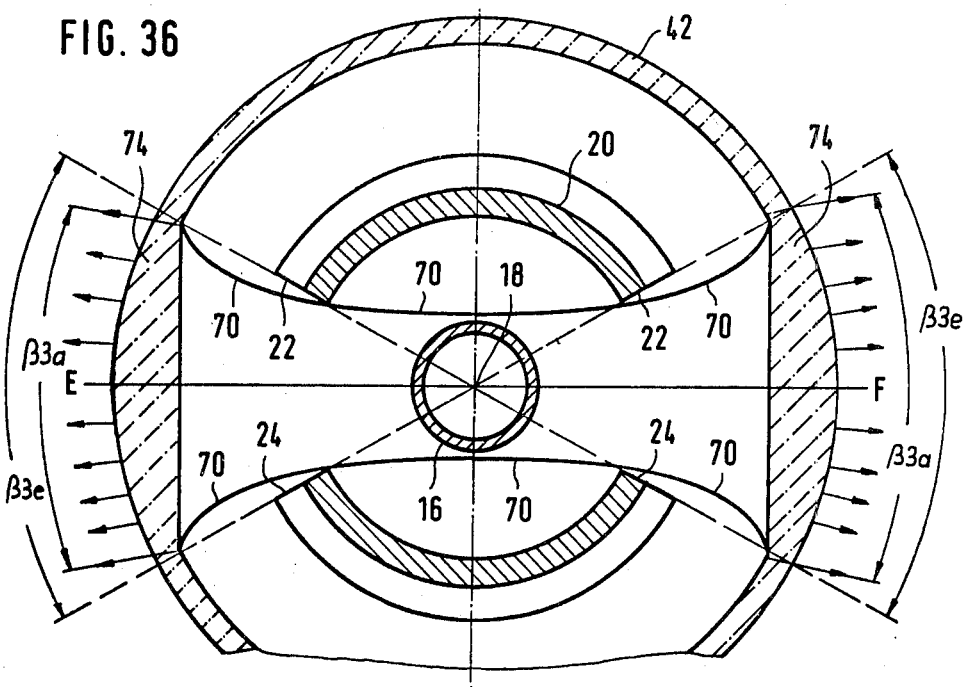
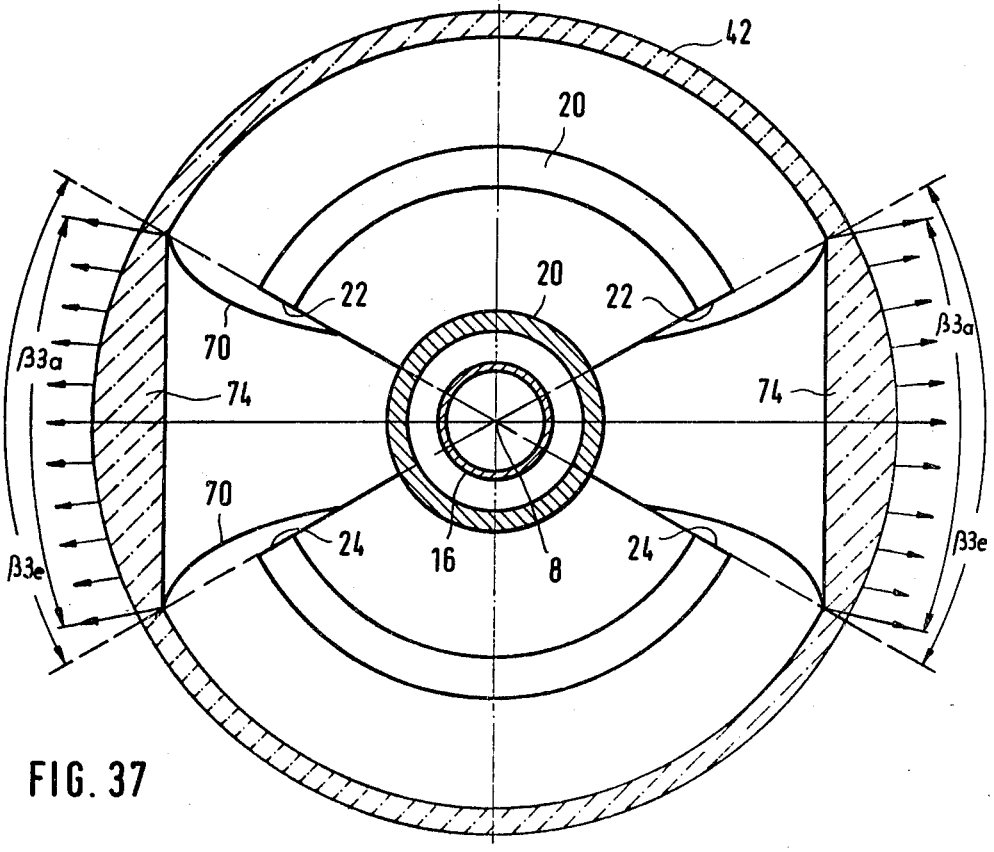
FIG. 37

LIGHTING FIXTURE WITH SIDE ESCAPE WINDOW

The invention relates to a lighting fixture, and more particularly to an indicating, tail, warning or signal light or a headlight for vehicles e.g. motor vehicles such as automobiles, trucks or motorcycles or the like and also non-motorized vehicles such as bicycles. What is meant by a "signal light", for example, is a blinking light, a parking light or a stop light. The lighting fixture according to the invention is also applicable as a stationary warning device, for example, to mark obstructions and road construction sites.

A main light beam of the lighting fixture should include, for example, a solid angle having a square cross section which extends, when mounted on a vehicle, in the direction of travel or opposite thereto, (a) in a horizontal plane including the optical axis of a concave reflector of the lighting fixture over an angular range of 20° (range of ±10° on both sides of the optical axis), and (b) in a vertical plane which includes the optical axis of the concave reflector of the lighting fixture and is perpendicular to the horizontal plane mentioned under (a) above, over an angular range of 20° (range of ±10° on both sides of the optical axis).

The main light beam should have a brightness that is as high as possible, so that the light can be seen from a great distance. In sharp curves or to traffic at the sides thereof, this main light beam is not visible, however. For this purpose, a second zone of light radiation is needed with an angular range having upward and downward limits of, for example, about 20° in the vertical plane, but fanned out widely in the horizontal plane.

It is accordingly an object of the invention to provide a lighting fixture which, with simple means, provides at least a second light radiation zone which is fanned out as wide as possible i.e. to provide one or two additional light beams which are emitted in the horizontal plane in a lateral direction.

Lighting fixtures that are equipped with concave reflectors are therefore sought to be made visible laterally in the axial plane which, in the installed condition, is the horizontal plane. In street or road traffic, this is particularly important for bicycle lights, the brightness of which is relatively low.

It is a further object of the invention to provide vehicles, for example, with front and tail lights in such a manner that the angle of the light emanating from the respective lighting fixtures is laterally large enough so that at least one of the lighting fixtures of the vehicle is visible from any viewing angle all around the vehicle. It is a further object of the invention to provide such lighting fixtures which will detract as little light as possible from the main light beam of the lighting fixture in order to offer the aforementioned lateral all-around visibility of the lighting fixture.

With the foregoing and other objects in view there is provided, in accordance with the invention, a lighting fixture comprising an enclosure, means disposed in the enclosure for supplying a source of light at a light center therein, means for directing a beam of light out of the enclosure from the source along a given optical axis, and means disposed at least at one side of the optical axis and in a common horizontal plane with the light center for directing part of the light from the source out of the enclosure.

In accordance with another feature of the invention, the means for directing the beam of light out of the enclosure comprises a concave reflector with the given optical axis for simultaneously reflecting and concentrating light from the source into the beam of light, and the means for directing part of the light from the source out of the enclosure comprises at least one aperture formed in the concave reflector.

In accordance with a further feature of the invention, the at least one aperture is located in the common horizontal plane on respective opposite sides of the optical axis.

A lighting fixture with a concave reflector, which has an aperture or opening for emerging light on only one side of the optical axis thereof so that the light rays directly emanating from the luminous body are collected in part by the concave reflector to form a main light beam and issue in part through the light emergence opening or aperture, is known from U.S. Pat. No. 1,680,154. In this heretofore known lighting fixture the light emergence opening or aperture is located in the upper side of the concave reflector, so that the light issuing thereat is radiated upwardly perpendicularly to the horizontal plane. According to the invention, however, the light emergence opening or aperture is disposed in the horizontal plane, wherein also the light center of the luminous body is situated. A second light radiation region for part of the light then forms a light fan which includes this horizontal plane.

In two-track vehicles, to make them visible to traffic from the side, lighting fixtures are employed which radiate an additional light beam only on one side of the optical axis thereof. On the other hand, the lighting fixture of a single-track vehicle (such as a bicycle or motorcycle) must radiate to the right-hand and to the left-hand sides. For this purpose, in accordance with the invention, the concave reflector is provided, on both sides of the optical axis thereof, with at least one light emergence aperture, respectively, which is disposed in the horizontal plane.

The larger the area of the light emergence apertures of the concave reflector, the smaller is the remaining reflecting area thereof. Any increase in the intensity of the second light radiation zone leads of necessity to a reduction in the intensity of the main light beam. A usable ratio of the various intensities is attained, in accordance with an added feature of the invention in that the partial surface of the reflector which is left open to provide the light emergence aperture or apertures is at most 50%, advantageously at most 35% and preferably at most 20% of the original reflecting, optically effective surface of the concave reflector. The reference quantity is that reflecting surface of the concave reflector which would be available if the light emergence apertures according to the invention were not there; if the remaining reflecting area were used as reference, instead, then the limits would be at most 100% or advantageously at most 54% or preferably at most 25%, respectively.

So as not to affect adversely the stability of the concave reflector, instead of one continuous light emergence aperture, a number of apertures could be provided, between which reflecting bridges would remain. In accordance with yet another feature of the invention, the light emergence aperture is formed as a slot defined by an upper and a lower edge in the reflector, the upper and the lower edges having a multiplicity of pairs of juxtaposed points, the pairs of points including with the light center respective lateral aperture angles of substantially equal size, namely substantially 20°. This is important in order not to tap off too much light from the main light beam; on the contrary, light should penetrate through the slot to the outside only into that angular range, wherein the eye of another traffic participant can normally be. No purpose is therefore served if the slot (as seen from the light center) is visible at one point under a narrower aperture angle and at another point under a wider aperture angle; the lateral aperture angle should rather always be about the same in any plane going through the light center perpendicularly to the horizontal plane. Since the concave reflectors usually are of parabolic or approximately parabolic shape, this means that, at portions of the concave reflector which are closer to the light source, the slot must be narrower and at portions which are farther away from the light source, the slot must be correspondingly wider in order to attain the same aperture angle.

So as to retain for the concave reflector adequate strength in spite of the slot, the base or receptacle and possibly also the outer rim which extends radially and does not contribute to the reflecting surface, remain intact and, in accordance with the invention, the slot extends in the horizontal plane from the base to the outer rim of the concave reflector.

Improved strength and a nevertheless adequate intensity of the second light radiation region is attainable in accordance with another feature of the invention by providing that the slot extends from a position substantially half-way between the base and the outer rim of the concave reflector to the outer rim thereof.

So that the vehicle is visible as well as possible from the side, in accordance with yet a further feature of the invention, the slot extends in direction from the outer rim of the concave reflector toward the base thereof so far that the outermost light ray issuing at the end of the slot encloses with the optical axis of the concave reflector a horizontal angle in the horizontal plane of at least 90°, and advantageously of at least 100° and preferably of at least 110°.

Lighting fixtures which are mounted at the front of vehicles usually have concave reflectors, the optical axis of which is inclined relative to the horizontal plane by a few degrees, so that the main light beam illuminates the road. The substantially horizontal position of the second light radiation zone should, however, not be affected by this inclination of the concave reflector. Therefore, in accordance with an additional feature of the invention, the upper and lower edges of the slot define with the light center a lateral aperture angle having an angle bisector disposed in a plane which intersects in a common horizontal line the aforementioned vertical plane in which the given optical axis of the reflector is disposed. The position of the slot relative to the horizontal plane and the luminous body therefore remains almost unchanged; only the concave reflector and the optical axis thereof are inclined, the distance of the slot from the luminous body being changed slightly but the lateral aperture angle remaining unchanged. In accordance with another feature of the invention and in actual practice it has been found to be advantageous when the horizontal line extends through the light center of the luminous body.

In accordance with other features of the invention, the lateral aperture angle defined by the upper and lower edges of the slot with the light center extends symmetrically to the horizontal plane and measures 5° to 30° and advantageously 10° to 26° and preferably 10° to 22°. However, since the eyes of the other traffic participants are generally above the horizontal plane of the lighting fixture according to the invention, in accordance with further features of the invention, the upper and lower edges of the slot define with the light center a lateral aperature angle extending asymmetrically to the horizontal plane in such a manner that a relatively larger partial angle is located above the horizontal plane of the lateral aperture angle of the asymmetrical slot and a relatively smaller partial angle of this lateral aperture angle is located below the horizontal plane.

In accordance with other features of the invention the relatively larger partial angle of the lateral aperture angle of the asymmetrical slot lying above the horizontal plane is from 2° to 14° and advantageously 4° to 11° and preferably 5° to 8° and, the relatively smaller partial angle of the lateral aperture angle of the asymmetrical slot situated below the horizontal plane is from 1° to 7° and preferably 2.5° to 5°.

If transparent or translucent reflector material is used for making the reflector, then it is unnecessary to provide cutouts therein in order to obtain the light emergence apertures or slots. On the contrary, in accordance with an added feature of the invention, a portion of the covering of reflective mirroring material is omitted from the base transparent or translucent material wherever a light emerging aperture or slot is to be made.

In accordance with an additional feature of the invention, a collecting lens, preferably the collecting lens of an incandescent lensend lamp, is disposed in front of the luminous body, and an optical system is disposed in front of the collecting lens for scattering light in only two opposite directions in the horizontal plane. Further in accordance with the invention, the optical system comprises a concave cylindrical lens (dispersing bar or trough). Thereby, all light that would otherwise issue above and below the small area which is to be illuminated perpendicularly to the horizontal plane, is beamed by the collecting lens of the incandescent lensend lamp toward the horizontal plane and is then caused to diverge by the dispersing trough which extends perpendicularly to the horizontal plane. This portion of the light is thereby especially intensified and is emitted in the horizontal plane and in planes parallel thereto.

In accordance with other features of the invention, the concave cylindrical lens which extends perpendicularly to the horizontal plane is thinnest in the middle. Furthermore, it may be plane parallel and may extend monotonically and preferably, with increasing thickness from the middle thereof.

Also in accordance with a further feature of the invention, the cylindrical lens is biconcave.

A widely fanned-out second light radiation region is obtained if, in accordance with yet another feature of the invention, the luminous body is located in a lensend incandescent lamp, and the collecting lens is the lens at the end of the lensend incandescent lamp, the light-scattering optical system being adapted to diverge light radiated by the collecting lens from the incandescent lamp at a radiation angle ($\delta a$) into a horizontal scatter angle ($2\gamma 3$) of at least 70° and advantageously at least 100° and preferably at least 120°.

In accordance with an added feature of the invention, the concave cylindrical lens is an integral part of the cover plate of the enclosure of the lighting fixture.

It is the basic idea of the invention to provide light that emanates laterally from a vehicle and has, in all areas perpendicular to the horizontal plane, a predetermined, approximately equal aperture angle. Considered from the manufacturing and tooling end, tolerances may sometimes occur which make it impossible to maintain the aperture angle accurately. Without deviating from the idea of the invention, certain tolerances must therefore be permitted. The characteristic shape of the slot is not lost thereby, however, namely, that it widens in a wedge-shaped manner from a truncated end near the base of the reflector in direction toward the outer rim of the reflector.

The intensity of the light of the second light radiation zone emanating from the slots is the unvaried intensity of the light emanating directly from the luminous body. The intensity of this second light radiation zone cannot be increased by increasing the lateral aperture angle. In order to attain a desirable increase in the intensity of the second light radiation zone, in accordance with another feature of the invention, the lighting fixture according to the invention includes an optical collecting system disposed in a light path extending from the luminous body and through the slot, the optical collecting system is disposed alternatively between the luminous body and the slot, advantageously in the slot, and preferably outside the concave reflector in front of the slot.

The optical collecting system can be realized in any desired manner, for example, with prisms. It has been found advantageous in practice and in accordance with the invention to provide an optical collecting system comprising a cylindrical collecting lens which is disposed in the horizontal plane and which is also symmetrical to this horizontal plane. If one slot is provided in the reflector on respective sides of the optical axis, then, in accordance with a further feature of the invention a cylindrical collecting lens disposed in the horizontal plane is provided, respectively at opposite sides of the optical axis.

If the lateral aperture angle, wherein the lateral light is gathered by the cylindrical collecting lens, becomes especially large, then the cylindrical collecting lens becomes so thick that it is difficult or, with present technical means, impossible to manufacture. In that case, in accordance with the invention a multistep cylindrical collecting lens which is symmetrical to the horizontal plane is provided. Also in accordance with the invention, the cylindrical collecting lens or the multistep cylindrical collecting lens is constructed so as to accept and radiate lateral light in the horizontal plane and in planes parallel to the horizontal plane, in a horizontal angle of at least 20°, and advantageously at least 30° and preferably at least 65°.

In order to attain a continuous second light radiation zone, in accordance with another feature of the invention, the scatter angle in which the cylinder lens disperses the light, and the horizontal angle, in which the cylindrical collecting lens or the multistep cylindrical collecting lens accepts and radiates the lateral light substantially adjoin one another, for example, in such a manner that a half-angle of the scatter angle forms with the horizontal angle a combined horizontal angle equal to at least 90° and advantageously to at least 95° and preferably to at least 105°.

If the concave reflector has two lateral slots in the horizontal plane, this has the result that these areas of the concave reflector which are occupied by the slots, reflect no light into the main light beam. The areas of the reflector opening lying in front of these slots are therefore not irradiated by the main light beam at all or are only inappreciably subjected thereto, so that the cylindrical collecting lenses can be extended thereto without disturbing the main light beam. According to the invention, therefore, the two lateral cylindrical collecting lenses or multistep cylindrical collecting lenses which are associated with the lateral light emergence apertures, on opposite sides of the optical axis, are elongated and mutually joined in front of the luminous body into one continuous cylindrical collecting lens or multistep cylindrical collecting lens bar extending over areas that are at best only slightly irradiated by the beam of the light, so that the radiated light fan, in the transition from the lateral light fan to the light fan radiated by the reflector aperture, is uninterrupted.

So that the lateral cylindrical collecting lenses additionally extend in front of the main light beam, they merge from the direction parallel to the optical axis to a direction perpendicular to the optical axis in a sharp bend or curve. In this especially advantageous construction, according to the invention, a continuous horizontal light fan is produced which extends from the main light beam to a direction perpendicular to the main light beam and, in fact, somewhat beyond, and makes the vehicle visible from all directions which form, with the direction of the main beam in the horizontal plane, an angle of up to 90° or even somewhat beyond.

If an especially high intensity is desired in the second light radiation zone, an angular range, as large as possible, of the light radiated by the luminous body perpendicularly to the horizontal plane must be covered. The hereinaforementioned multistep cylindrical collecting lens is advantageously used for this purpose. An extremely inexpensive construction of high brightness in the radiation regions necessary for traffic safety is thus attained.

In accordance with another feature of the invention, the continuous cylindrical collecting lens or multistep cylindrical collecting lens is constructed so as to accept and radiate in longitudinal direction thereof (in the axial horizontal plane and in planes parallel thereto) the light from the luminous body in an angular range of at least 180° and advantageously at least 190° and preferably at least 210°.

The height of the cylindrical collecting lens or multistep cylindrical collecting lens associated with the reflector aperture must not be so large that the main light beam is disturbed. However, the height of the cylindrical collecting lens or the multistep cylindrical collecting lens limits the angular range covered and, thereby, the intensity of the horizontal light fan. In order to increase the intensity of this horizontal light fan and/or to be able to reduce the height of the cylindrical collecting lens or the multistep collecting lens associated with the reflector aperture, so that there is less disturbance of the main light beam, it is advantageous to mount an axially-symmetrical collecting lens in front of the luminous body. In actual practice, it is advantageous to employ a lensend or lenticular lamp, the collecting lens of which is located between the luminous body and a further optical collecting system. Reference has already been made to such a lensend lamp hereinbefore in another context. It is also advantageous to dispose in front of the collecting lamp, a dispersion bar or trough, such as has also been mentioned hereinbefore.

It is advantageous, moreover, to dispose the cylindrical dispersion bar in an interruption or break in the cylindrical collecting lens or the multistep cylindrical collecting lens whereat, for reasons involving mold-technology, both parts are preferably mutually merged.

In accordance with a further feature of the invention, the optical collecting system, namely, the cylindrical collecting lens or the multistep cylindrical collecting lens is constructed so as to accept the lateral light, in planes perpendicular to the horizontal plane, in a lateral aperture angle of at least 15° and advantageously of at least 35° and preferably of at least 80°, and collect the accepted lateral light toward the horizontal plane.

The collecting action of the cylindrical collecting lens or the multistep collecting lens is such, in accordance with yet another feature of the invention, that it radiates the accepted lateral light in planes perpendicular to the horizontal plane with a lateral aperture angle of the light radiation of 5° to 50° and advantageously of 10° to 30° and preferably of 15° to 25°.

In accordance with an added feature of the invention, at least one of these lateral aperture angles, respectively, of light acceptance and of light radiation are symmetrical with respect to the horizontal plane.

Bicycle, motor cycle and motor vehicle tail lights are generally disposed considerably lower than the eyes of the traffic participants coming from the side. However, the lateral light beam for warning the traffic from the side, needs to be visible only in that height range wherein it is observed by the traffic on the side. It is therefore sufficient, and in accordance with an additional feature of the invention, for the lateral aperture angle of the radiated light to extend symmetrically with respect to the horizontal plane, the part of the lateral aperture angle located above the horizontal plane being larger than the part thereof located below the horizontal plane.

The radiation takes place, in advantageous embodiments of the invention, without any changes in the angles in the horizontal plane i.e. the horizontal angle of the light radiation in the horizontal plane is equal to the horizontal angle of the light acceptance. Then, the fanning-out of the second light radiation zone afforded by the width of the slots is sufficient, in the horizontal plane, to make the light of the vehicle visible also on sharp curves.

An especially continuous transition from the lateral light fan to the light fan radiated through the reflector aperture is obtained if, in accordance with an additional feature of the invention, the continuous cylindrical collecting lens is curved in such a manner as to extend into the slot or slots of the concave reflector.

In accordance with yet another feature of the invention, the lighting fixture enclosure has a cover plate, and the cylindrical collecting lens or multistep collecting lens is an integral part of the convex plate of the lighting fixture.

A closed construction of the lighting fixture according to the invention is attainable in all of the embodiments indicated herein, by constructing it as a sealed-beam lamp and by welding the cover plate and the reflector together to form an airtight, closed structure.

To increase the intensity in the second light radiation zone in a lighting fixture according to the invention wherein a slot is formed on only one side of the optical axis in the horizontal plane, there is provided a spherical reflector or a multistep spherical reflector extending over an angular range and disposed between the light center or luminous body and the concave reflector on the other side of the optical axis and opposite the slot whereby part of the light radiated directly from the light center or luminous body and impinging on the spherical reflector or multistep spherical reflector is, in turn, radiated therefrom through the slot.

In accordance with yet another feature of the invention, the spherical reflector or multistep spherical reflector is disposed in a region of the concave reflector, whereby manufacturing and assembly costs for an additional component are eliminated.

In accordance with yet a further feature of the invention, the luminous body is received in an incandescent lamp, and the spherical reflector or multistep spherical reflector is constructed as an integral part of the incandescent lamp, for the reasons of manufacturing technology.

As a front light, preferably a bicycle lamp, a lighting fixture assembly, constructed in accordance with the invention, with a first lighting fixture of one of the foregoing embodiments, is also provided with a second lighting fixture according to the invention which is combined with the first lighting fixture into a structural unit, the second lighting fixture having a concave reflector located substantially outside the concave reflector of the first lighting fixture, the main axes or the optical axes of the two concave reflectors intersecting to form an angle with each other of 2° to 6° and advantageously of 3° to 5° and preferably of 4° to 5°, the main or optical axis of the first lamp, in installed condition of the lighting fixture assembly being disposed in the horizontal plane, the first lighting fixture being equipped with an incandescent lamp of relatively smaller current drain and serving as a position light, while the second lamp, the main or optical axis of which is declined from the horizontal plane in the installed condition of the lighting fixture assembly, is provided with an incandescent lamp of relatively larger current drain and serves to illuminate the road. Both lighting fixtures, the position light according to one of the aforementioned embodiments of the invention and the light serving to illuminate the road, are combined in the light fixture assembly with precisely determined and fixed mutual orientation of the main or spherical axes thereof, so that if the position light is disposed horizontally, the other lamp is automatically in a position suitable for illuminating the road. This is made advantageously possible, in accordance with another feature of the invention, by providing a water or spirit level mounted on the common housing for the two lighting fixtures of the lighting fixture assembly.

If this lighting fixture assembly is used as a bicycle headlight, in accordance with an added feature of the invention, means are provided connectible to a battery for energizing the first-mentioned lighting fixture with battery current, so that the bicycle remains visible also when standing still. Means are also provided which are selectively connectible to a battery or a mechanical generator for energizing the second lighting fixture when illumination of the road is desired or required.

An especially inexpensive embodiment of the lighting fixture according to the invention has no concave reflector. In accordance with this concomitant embodiment of the invention, the lighting fixture comprises an incandescent lamp having a luminous body therein, an elongated collecting lens or multistep collecting lens disposed in a horizontal plane and extending in front of and lateral to the incandescent lamp, the luminous body being of a construction so as to radiate light rays in an aperture angle for collection by the elongated collecting lens or multistep collecting lens in direction toward the horizontal plane, the elongated collecting lens or multistep collecting lens, in the horizontal plane and in planes parallel thereto, accepting and radiating the light of the lumnious body in an angular range of at least 160°, and advantageously at least 180° and preferably at least 210°. Further, in keeping with the invention, the elongated collecting lens or multistep collecting lens is symmetrical with respect to the horizontal plane.

Other features which are considered as characteristic for the invention are set forth in the appended claims.

Although the invention is illustrated and described herein as embodied in a lighting fixture, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIGS. 1 to 3 are side and rear elevational and top plan views, respectively, of a motor vehicle showing diagrammatically the disposition of lighting fixtures thereon according to the invention;

FIG. 10 is a longitudinal sectional view of a lighting fixture according to the invention, the optical axis of which lies in the horizontal plane;

FIG. 11 is a cross-sectional view of FIG. 10 taken along the line XI—XI in the direction of the arrows;

FIG. 12 is a front elevational view of FIG. 10;

FIG. 13 is a longitudinal sectional view of FIG. 12 taken along the horizontal plane E–F;

FIG. 14 is a view similar to that of FIG. 10 of another embodiment of the lighting fixture;

FIG. 15 is a cross-sectional view of FIG. 14 taken along the line XV–XV in direction of the arrows;

FIG. 16 is a front elevational view of FIG. 14;

FIG. 28 is a diagrammatic front elevational view of a lighting fixture according to the invention formed with only one slot, one multistep cylindrical collecting lens and one multistep spherical reflector;

FIG. 29 is a cross-sectional view of FIG. 28 taken along the plane E–F;

FIG. 30 is a perspective view of the multistep cylindrical collecting lens of FIG. 28;

FIG. 31 is a cross-sectional view of the multistep cylindrical collecting lens of FIG. 30 taken along the plane E–F;

Figure 46:
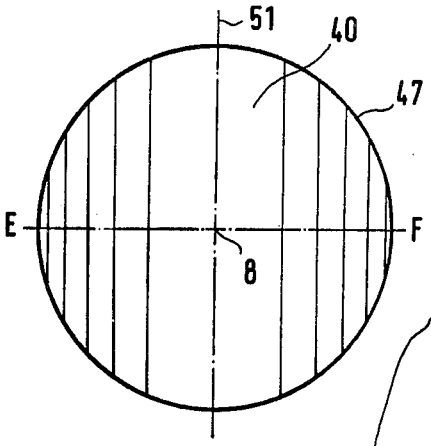
Figure 47:
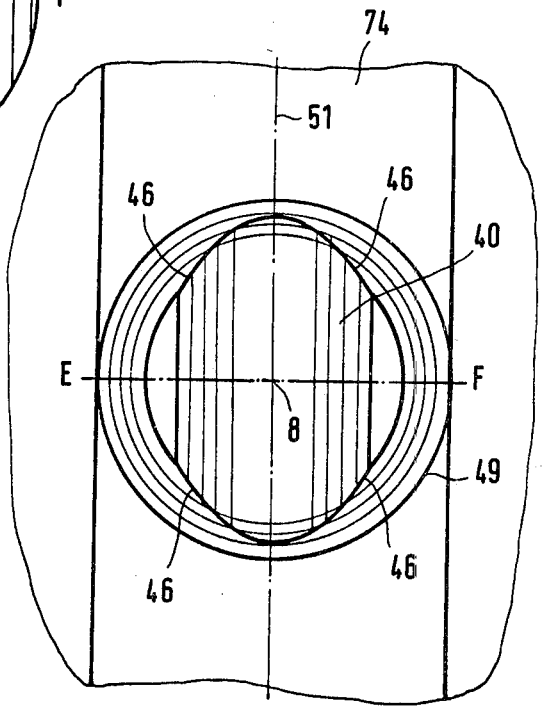
Figure 50:
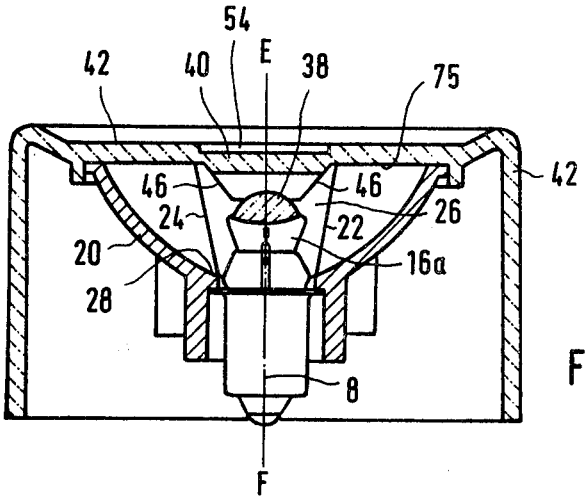
Figure 48:
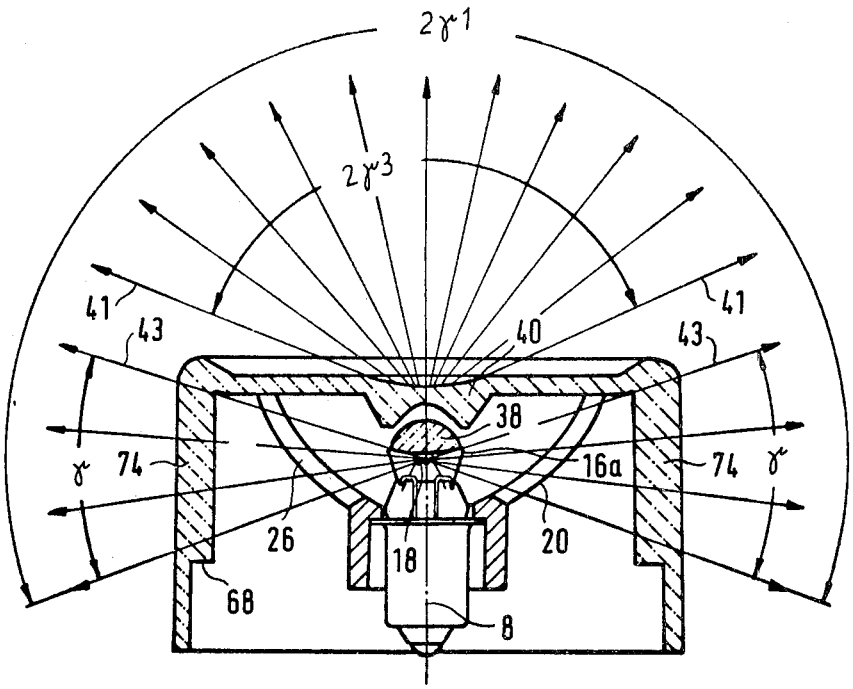
Figure 49:
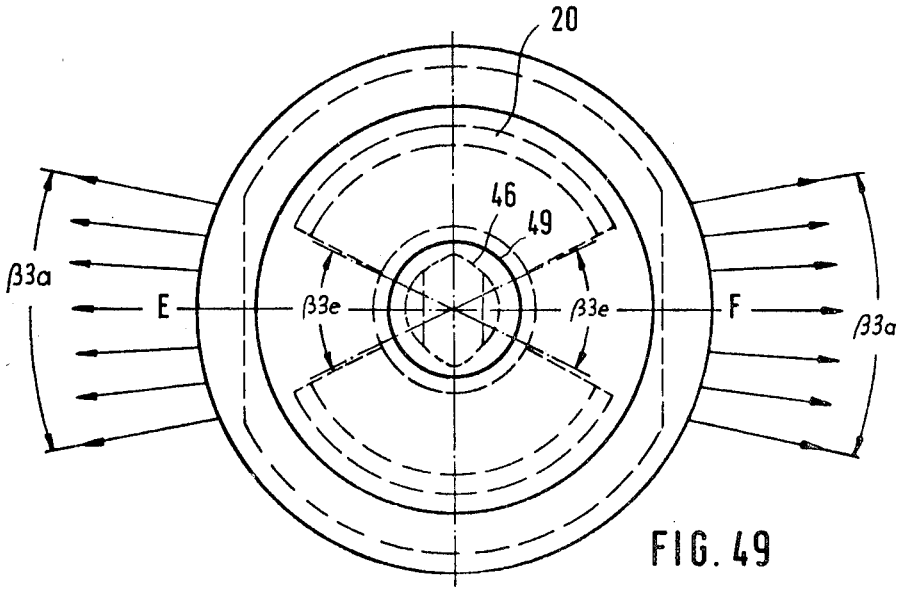
Figure 51:
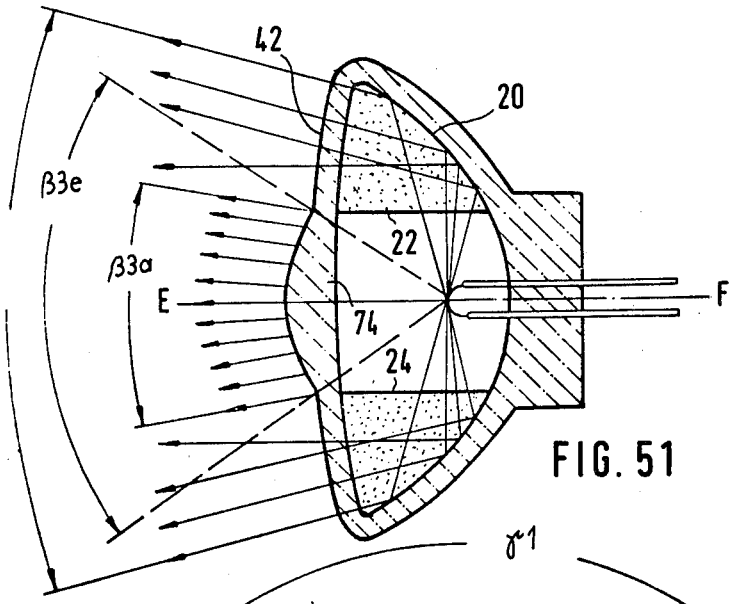
Figure 52:
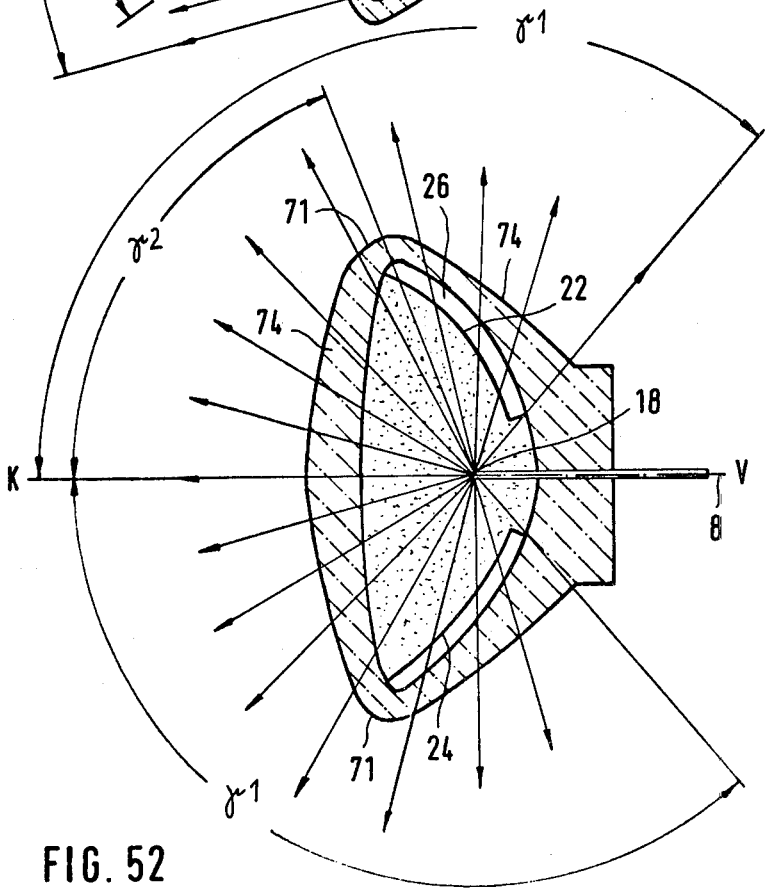
Figure 53:
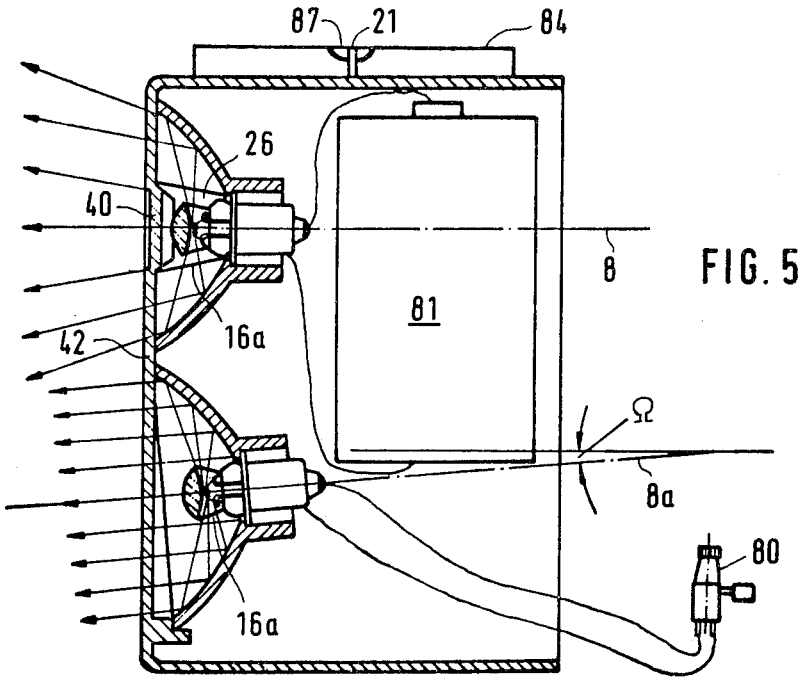
Figure 54:
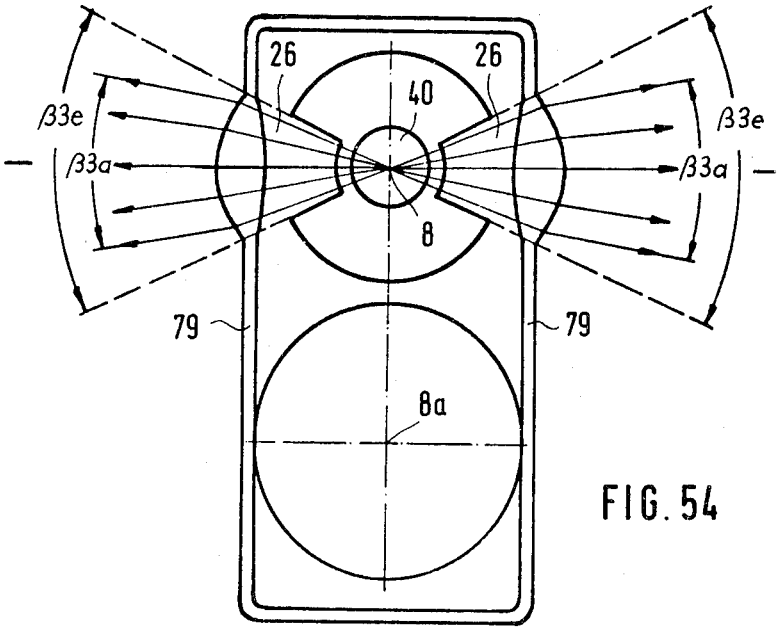
Figure 55:
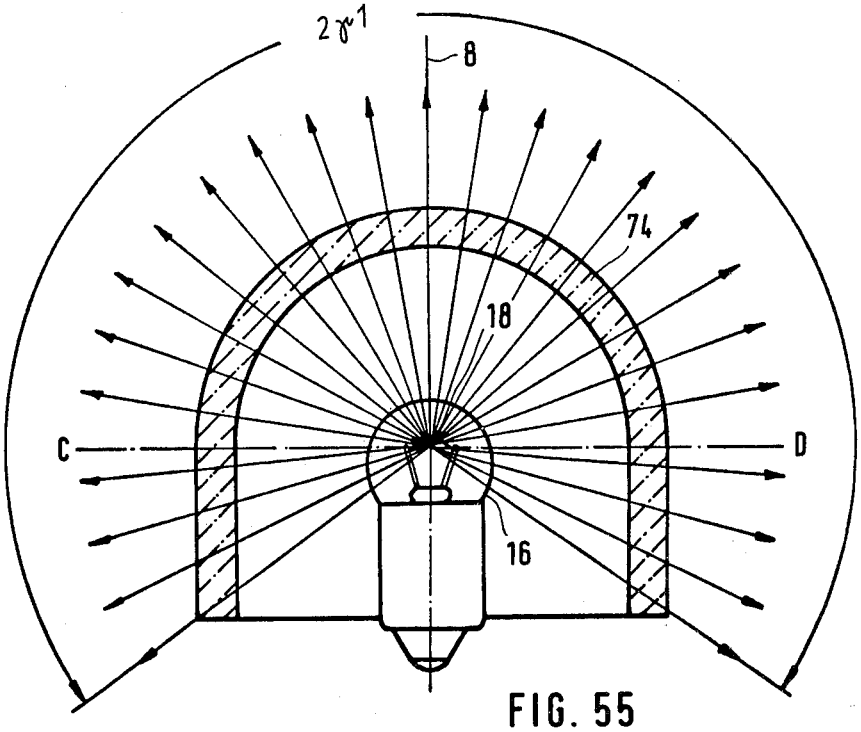
Figure 56:
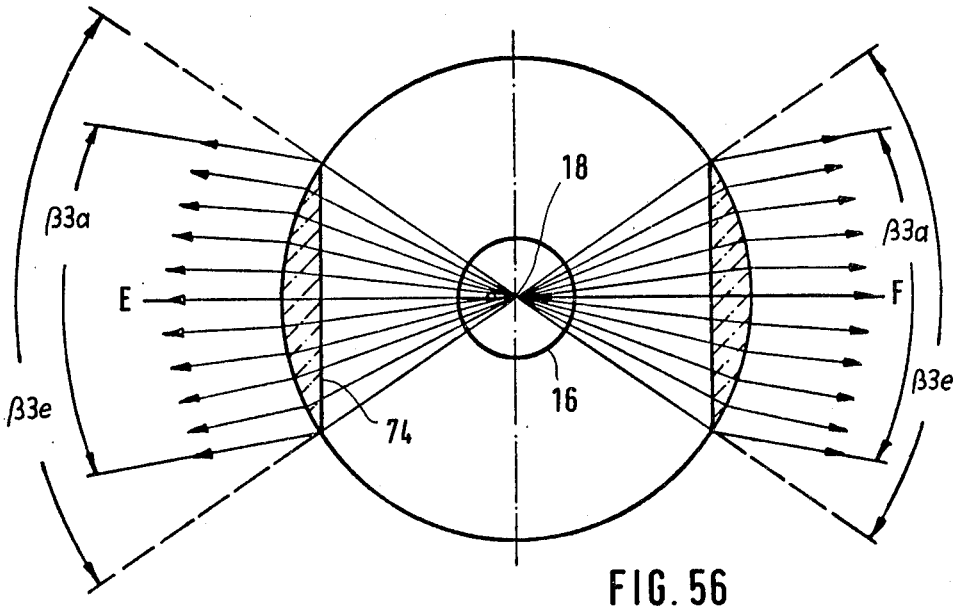

FIGS. 32 to 37 are respective sectional views of a lighting fixture according to the invention, the lateral cylindrical collecting lenses of which are joined together in front of the luminous body; FIG. 32 being a longitudinal cross-sectional view taken along a horizontal plane E–F, FIG. 33 being a similar view taken along the vertical plane K–V; FIGS. 34 and 35 being cross-sectional views of FIG. 32, respectively taken along the lines taken along the lines I—I and II—II, parallel to the plane K–V of FIG. 32; and FIGS. 36 and 37 also being cross-sectional views of FIG. 32, respectively taken along the lines III—III and IV—IV perpendicularly to the optical axis of the reflector;

FIGS. 38 to 45 are views similar to those of FIGS. 32 to 37 of another lighting fixture according to the invention additionally having a lensed or lenticular lamp and a biconcave cylindrical dispersion lens;

FIGS. 46 and 47 are plan views of the biconcave cylindrical dispersing lens, respectively from the outside and from the inside of the lighting fixture;

FIG. 48 is a longitudinal sectional view of another embodiment of the lighting fixture according to the invention;

FIG. 49 is a diagrammatic top plan view of FIG. 48;

FIG. 50 is a sectional view perpendicular to that of FIG. 48;

FIGS. 51 and 52 are respective longitudinal sectional views perpendicular to one another, of a sealed-beam lamp according to the invention;

FIGS. 53 and 54 are respective sectional and front elevational views of a lighting fixture assembly with two lighting fixtures, according to the invention; and FIGS. 55 and 56 are respective longitudinal sectional and cross-sectional views of a lighting fixture without reflector in accordance with the invention.

Referring now to the drawings and first, particularly, to FIGS. 1 to 3 thereof, there is shown a motor vehicle 2 in a side view in FIG. 1, a rear view in FIG. 2 and a top view in FIG. 3. The motor vehicle 2 has tail lights 4 and 6, each tail light 4, 6 emits a main light beam rearwardly into a rear angular zone $\beta 1$, which is disposed in a vertical plane VK (see FIGS. 20, 21, 22) in which the optical axis 8 of the tail lights 4 and 6 is located. The front parking or position lights 10 and 12 of the motor vehicle 2 emit a main light beam which covers or extends over a front angular zone $\beta 2$ lying in the vertical plane VK in which the optical axis 8 of these lighting fixtures 10 and 12 is disposed. The angular zones $\beta 1$ and $\beta 2$ define the limits or boundaries of the main light beam only in the vertical plane VK; obviously, the main light beam extends over a solid angle, as explained hereinbefore in the introduction hereto.

The optical axes 8 of the main light beams of the lighting fixtures 4, 6, 10 and 12, in the embodiment of FIGS. 1 to 3, are disposed in a respective horizontal plane EF in which the concentration points or centers of the light emitted by the respective luminous bodies of these lighting fixtures are located.

FIG. 2 shows the motor vehicle 2 of FIG. 1 from the rear. A second light radiation or beam zone of each tail light 4 and 6 is shown diagrammatically in FIG. 2 and extends over or covers a lateral aperture angle $\beta 3$ which is disposed in the vertical planes that are perpendicular to the horizontal plane EF and extend through the light center or concentration point of the luminous body of the respective lighting fixture. The size of this lateral aperture angle $\beta 3$ results from the dimensions of a slot formed in the concave reflector and/or a cylindrical collecting lens of the respective lighting fixture in accordance with the invention as will be explained hereinafter in further detail.

FIG. 3 shows the motor vehicle 2 of FIG. 1 in a top plan view. The illustrated arrows indicate the directions of light emanation or emergence, which form a so-called light fan. The light fans of the lighting fixtures 4, 6, 10 and 12 extend in the horizontal plane EF (the plane of drawing of FIG. 3) outwardly over an outer horizontal angle $\gamma 1$ and inwardly over an inner horizontal angle $\gamma 2$. In the embodiment of FIG. 3, the outer horizontal angles $\gamma 1$ or the lighting fixtures 4, 6, 10 and 12 are 110°, respectively, whereas the inner horizontal angles $\gamma 2$ of these lighting fixtures are 50°, respectively.

Figure 4:
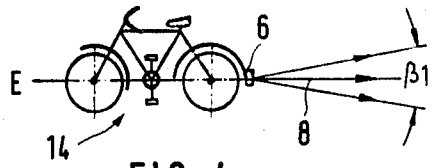
FIGS. 4 to 6 are side and rear elevational and top plan views, respectively of a bicycle having a tail light disposed thereon in accordance with the invention.
Figure 5:
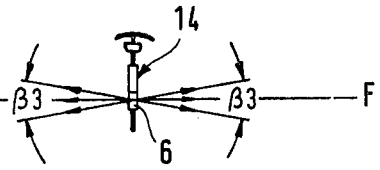
Figure 6:
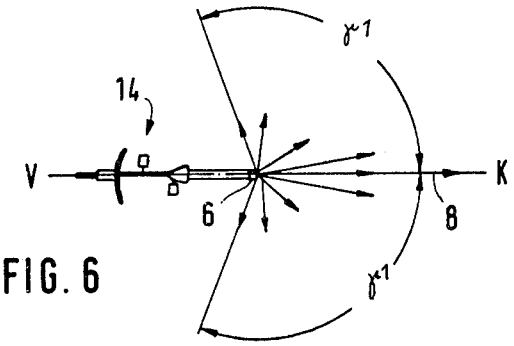
Figure 7:
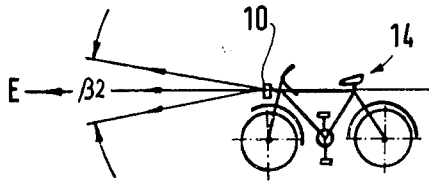
FIGS. 7 to 9 are side and front elevational and top plan views, respectively, of a bicycle having a head lamp disposed thereon in accordance with the invention.
Figure 8:
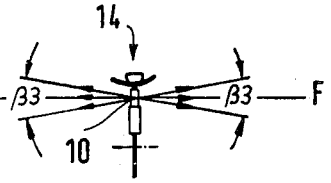
Figure 9:
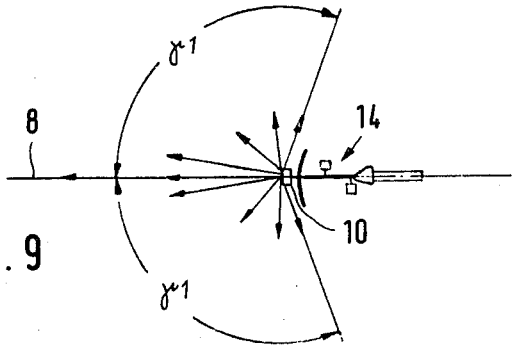

FIGS. 4 to 9 show a bicycle 14 with a rear or tail light 6 and a front position light or a headlamp 10. With regards to the rear angle zone $\beta 1$, the front angle zone $\beta 2$ as well as the lateral aperture angle $\beta 3$, reference is made to the discussion hereinbefore. In contrast to FIG. 3, however, there are shown in FIGS. 6 and 9, two equal outer horizontal angles $\gamma 1$, in the case of a single-track vehicle (a bicycle, motorcycle or the like), the tail light 6 and the front position light or headlamp 10 must emit a wide horizontal light fan to the right-hand side and to the left-hand side to be visible to the traffic coming from either side.

The luminous body 18 of the incandescent lamp 16 of the lighting fixture according to the invention shown in FIG. 10 occupies at least part of the focal region of the concave reflector 20. The latter focusses the light rays directly emanating from the luminous body 18 to form a main light beam.

In the vertical cross section of FIG. 10 (taken along the vertical plane VK, see FIGS. 20, 21 and 22), the upper edge 22 and the lower edge 24 of a slot 26, through which the horizontal plane EF extends, are readily apparent. The slot 26 widens from the base 28 of the concave reflector 20 toward the outer rim 30 of the same, so that the lateral aperture angle $\beta 3$ (see FIG. 11, which is a cross-sectional view of FIG. 10 taken along the line XI—XI in direction of the arrows) is the same in all planes which go through the light center or concentration point of the luminous body perpendicularly to the horizontal plane EF. This increase in the width of the slots 26 can also be seen in FIG. 12, which provides a front view of the lighting fixture of FIG. 10 or a view opposite to the direction of the main light beam. FIGS. 11 and 12 show that for use of the lighting fixture in a single-track vehicle, two slots 26 are provided. In double-track vehicles, which generally have two tail lights, the concave reflector 20 can remain closed on the inside of the vehicle, so that a slot 26 is provided only on the outside.

FIG. 13 is a cross-sectional view of the lighting fixture of FIG. 10 taken along the horizontal plane EF. In this view of FIG. 13, the slots 26 are shown extending from the outer rim 30 of the concave reflector 20 down to the base 28 thereof, so that the horizontal angle $\gamma 1$ of the light fan has a value of about 120° which is the greatest possible value attainable in view of the other dimensions of this lighting fixture.

In the ambodiment of FIGS. 10 to 12, the slot 26 is symmetrical to the horizontal plane EF i.e. the portion $\beta o$ located above the horizontal plane EF of each lateral aperture angle $\beta 3$ (see FIG. 11) is as large as the portion $\beta u$ located below the horizontal plane EF of this lateral aperture angle $\beta 3$. FIGS. 14 to 16, on the other hand, show an asymmetrical construction of the slot 26; otherwise, the structure of the embodiment of FIGS. 14 to 16 agrees with that of FIGS. 10 to 12. FIG. 14, like FIG. 10, is a cross-sectional view taken along the vertical plane VK; FIG. 15 is a sectional view of FIG. 14 taken along the line XV—XV; FIG. 16 is a view of the lighting fixture of FIG. 14 in a direction opposite the direction of the main light beam.

That part $\beta u$ of the second light radiation or beam zone which is disposed below the horizontal plane EF strikes the road surface after travelling over a relatively short distance. It cannot, however, be suppressed completely, because otherwise, the tail light, for example, of a bicycle might not be visible from the side if the bicycle were in an inclined position when making a curve. It is possible, however, to reduce this lower portion $\beta u$ of the lateral aperture angle $\beta 3$ to about one-half, whereas the upper portion $\beta o$ thereof in the embodiment of FIGS. 14 to 16 is about as large as in FIGS. 10 to 13. This reduction of the lower lateral aperture angle portion $\beta u$ leads to an improvement in the intensity of the main light beam which is weakened due to the provision of the slots 26.

Figure 17:
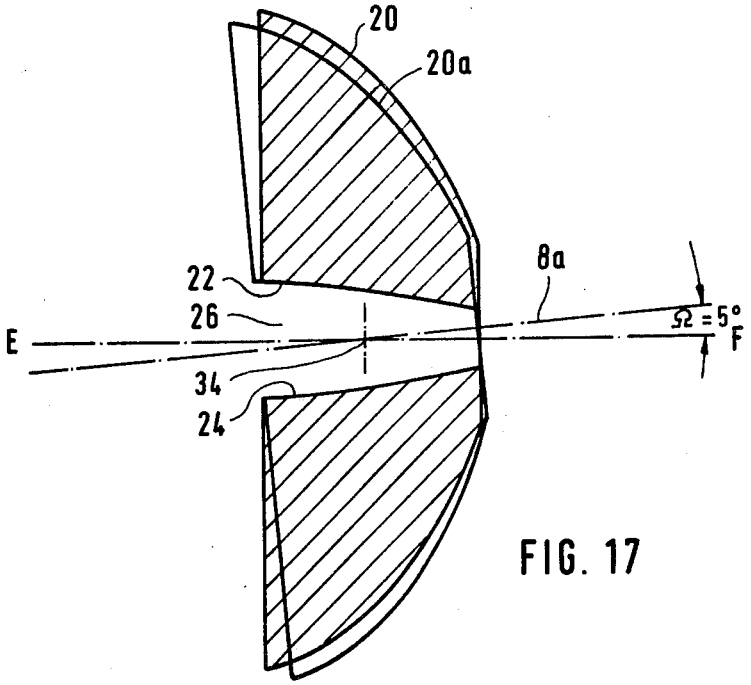
FIGS. 17 to 19 are longitudinal sectional views of lighting fixtures according to the invention, which are so disposed that the optical axes of which define an angle with the horizontal plane.

FIG. 17 provides an illustration similar to those of FIGS. 10 and 14, however, the reflector 20, suitably shaded, is indicated only diagrammatically. The slot 26, defined by the edges 22 and 24, can be seen in FIG. 17. A heavy solid line indicates a reflector 20*a* which is inclined at an inclination angle $\Omega = 5°$ relative to the horizontal plane EF. The reflector 20*a*, however, has a slot 26 coinciding with the corresponding slot 26 of the non-inclined reflector 20 and being defined virtually by the same edges 22 and 24. If it was required that the lateral aperture angles $\beta 3$ be the same in the case of the inclined reflector 20*a* as in the case of the non-inclined reflector 20, the exactly curved shape of the edges 22, 24 which would otherwise be determinable mathematically only with great difficulty, would be obtained due to this requirement. In practice, however, a slot 26 having edges 22 and 24 which are exactly straight as illustrated in FIG. 17, are much easier to produce than a slot with curved edges. Since the lateral aperture angles $\beta 3$ in all planes extending perpendicularly to the horizontal plane EF passing through the light center or concentration point of the luminous body 18 are sufficiently equal to one another when the slot is formed with straight edges (in FIG. 17), there is no deviation from the basic principle of the invention if the edges 22 and 24 are made straight.

Figure 18:
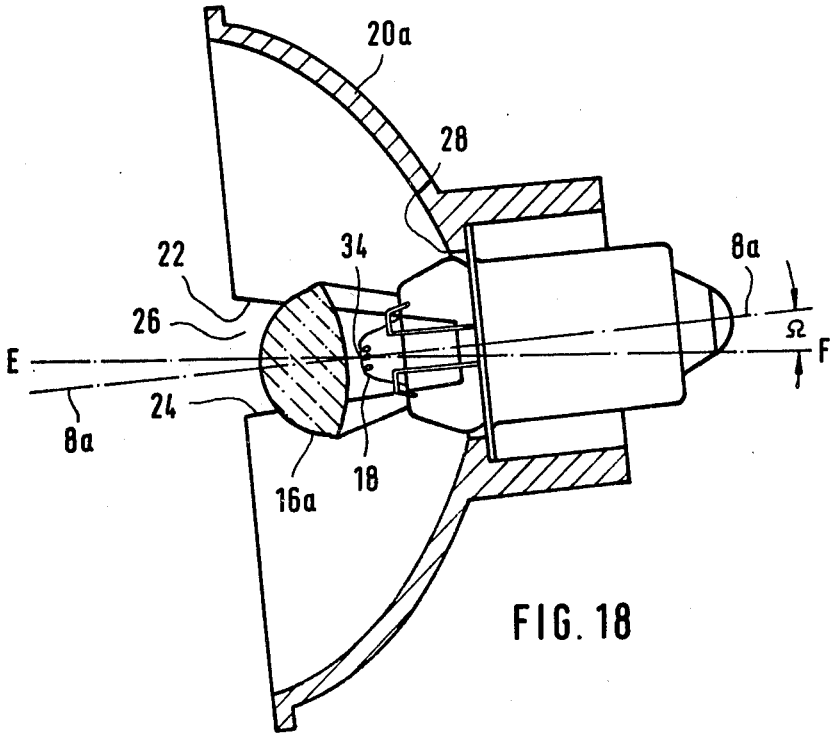

FIG. 18 shows a lighting fixture according to the invention with a concave reflector 20*a* inclined at an inclination angle $\Omega$to the horizontal plane EF. The inclination angle $\Omega$denotes the angle between the optical axis 8*a* and the horizontal plane EF. The optical axis 8*a* is simultaneously the axis of the lensed or lenticular lamp 16*a* and pierces or penetrates the horizontal plane EF at the light center or concentration point 34 of the luminous body 18 of the lensed or lenticular lamp 16 (see also FIG. 17).

The slot 26 of the lighting fixture of FIG. 18 produces lateral aperture angles $\beta 3$ which are symmetrical to the horizontal plane EF. The angle bisectors of these aperture angles form the family of straight lines shown in FIG. 20, which emanate or extend from the light center or concentration point 34 of the luminous body 18, and all of which lie in the horizontal plane EF.

Figure 20:
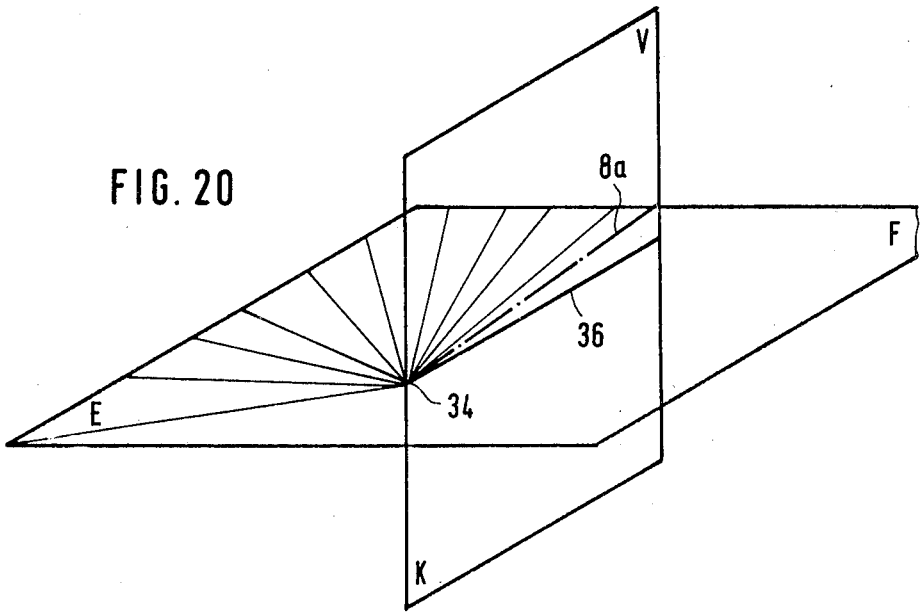
FIGS. 20 to 22 are diagrammatic views of appropriate geometric planes for explaining the solid angle relationship.

The vertical plane VK extends through the optical axis 8*a* of the concave reflector 20*a*. This plane VK intersects the horizontal plane EF at a horizontal straight line 36, as shown in FIGS. 20 through 22.

Figure 19:
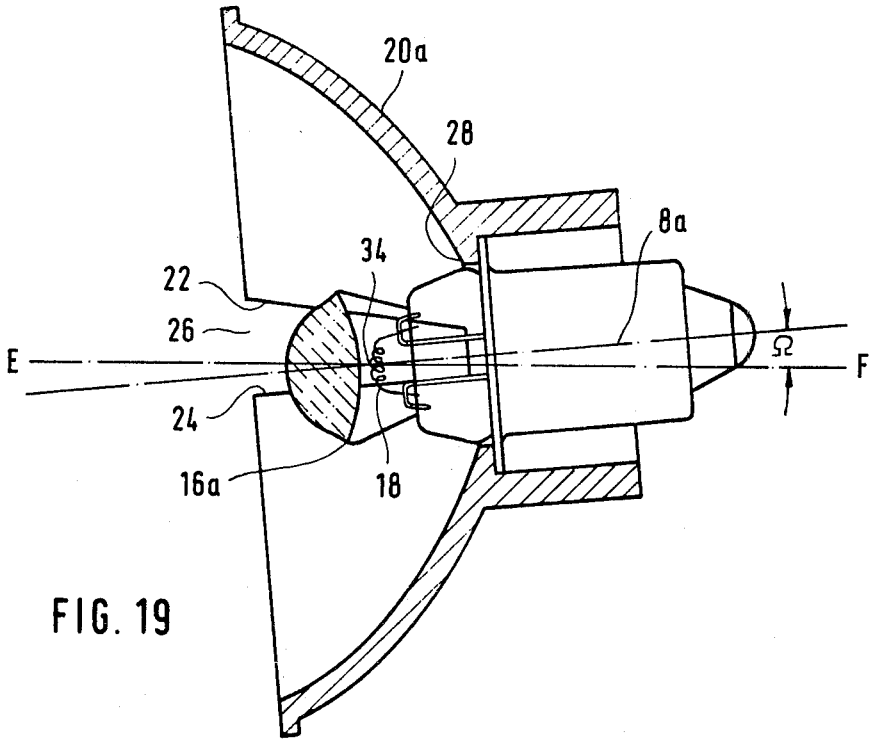

Whereas FIG. 18 (corresponding to FIGS. 10, 11 and 12) shows the disposition of the slot 26 symmetrically to the horizontal plane EF, an asymmetrical disposition is shown in FIG. 19 (corresponding to FIGS. 14, 15 and 16). Otherwise, FIG. 19 is the same as FIG. 18. Here, too, the optical axis 8*a* of the reflector 20*a* is inclined relative to the horizontal plane EF at the inclination angle $\Omega$. The angle bisectors of the lateral aperture angles $\beta 3$ lie in one plane.

Figure 22:
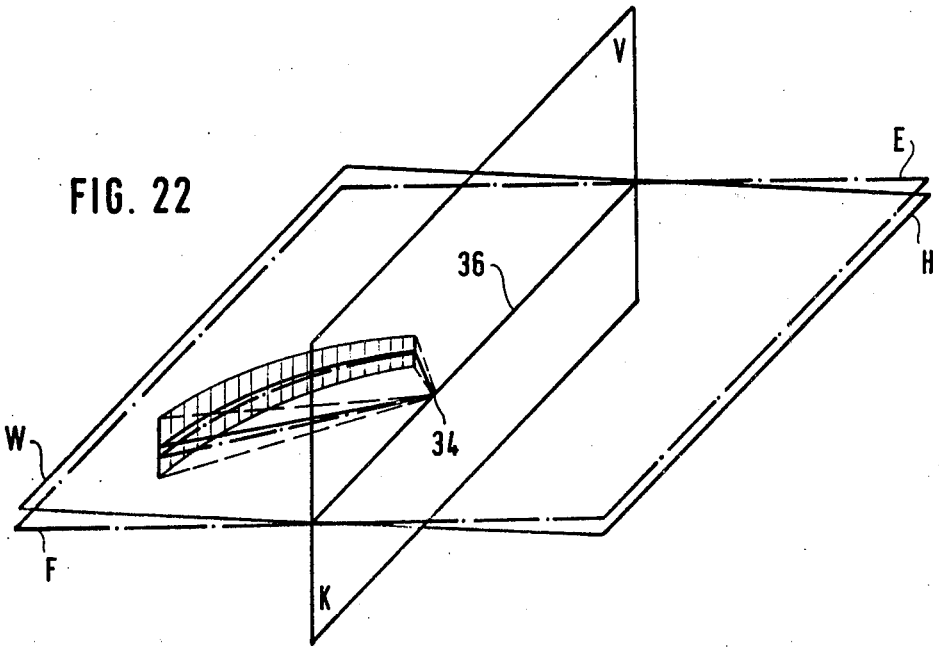

In FIG. 22, this plane is identified by WH. In comparing the plane WH with the horizontal plane EF shown in phantom in FIG. 22, it is apparent that the plane WH is inclined slightly with respect to the horizontal plane EF (because of the asymmetrical disposition of the slots 26). In this case, too, the vertical plane VK, which includes the optical axis 8*a* of the inclined concave reflector 20*a*, intersects the plane WH of the angle bisectors at the horizontal line 36.

Figure 21:
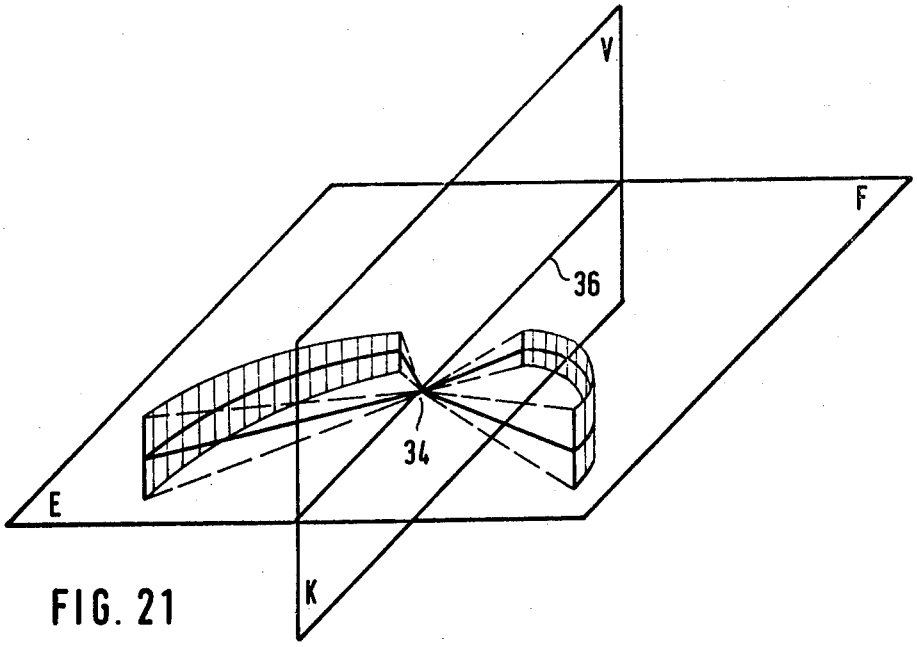

In FIG. 21, the angle bisectors of the slot 26 at the right-hand side of the lighting fixture and the slot 26 at the left-hand side thereof lie together in the horizontal plane EF. In the asymmetrical disposition of FIG. 22, however, the angle bisectors of the lateral aperture angles $\beta 3$ of the slot 26 at the left-hand side of the lighting fixture are associated with a different plane WH than the angle bisectors of the lateral aperture angles $\beta 3$ of the slot 26 at the right-hand side of the lighting fixture; for this reason to keep the figure simple and to avoid obliteration of detail, only a single slot 26 with the plane WH of the angle bisectors of the lateral aperture angles $\beta 3$ associated therewith is shown in FIG. 22. The corresponding plane of the angle bisectors of the lateral aperture angles $\beta 3$ of the other slot would intersect with the illustrated planes WH, EF and VK also at the horizontal lines 36.

In the lighting fixture of FIG. 19, the angle portion $\beta o$ of the lateral aperture angle $\beta 3$ situated above the horizontal plane EF is about 10°, while the angle portion $\beta u$ of the lateral aperture angle $\beta 3$ situated below the horizontal plane EF is only about 5°. These angles $\beta 3$, $\beta o$ and $\beta u$ are not identified in FIG. 19.

Figure 23:
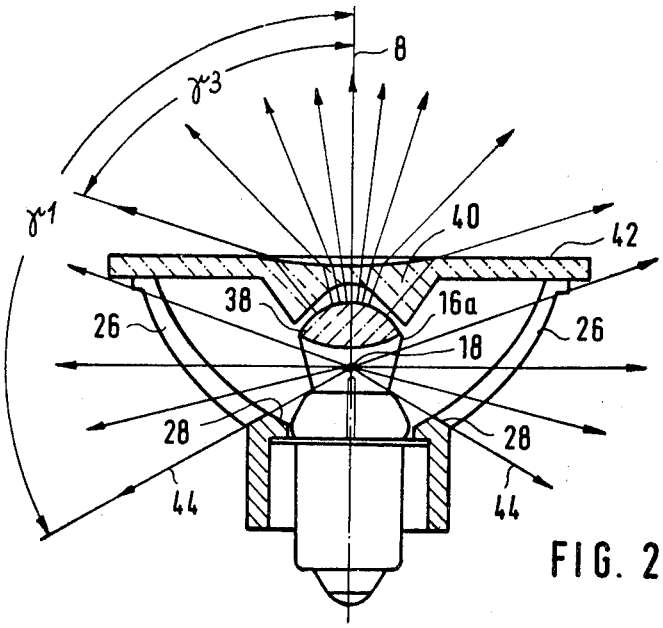
FIGS. 23 and 24 are longitudinal sectional views taken perpendicularly to one another of a lighting fixture according to the invention with a lensed or lenticular incandescent lamp and a biconcave cylindrical dispersion lens.
Figure 24:
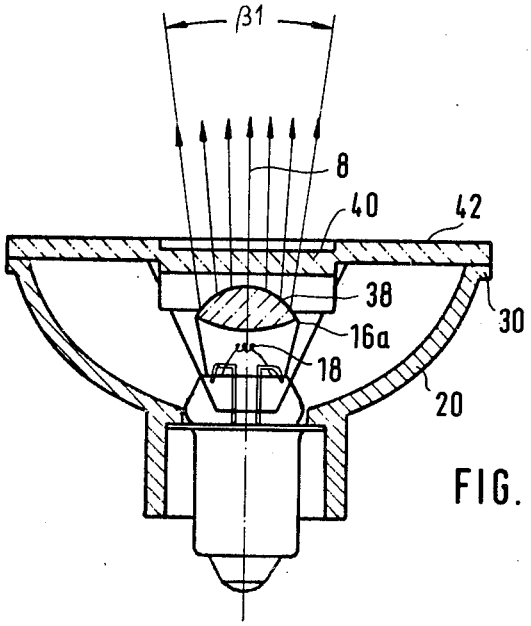

FIG. 23 shows a horizontal cross-sectional view and FIG. 24 a vertical cross-sectional view of a particularly advantageous lighting fixture according to the invention.

Part of the light emanating from the luminous body 18 of the lensend or lenticular lamp 16*a* is radiated or beamed in direction of the optical axis 8 and in a large solid angle about the latter without being collected by the concave reflector 20 to form the main light beam. This light can be used without reducing the intensity of the main light beam. To this end, the incandescent lamp is constructed as a lensend or lenticular lamp 16*a*, the collecting lens 38 of which concentrates the light that has not been collected into the main light beam into a bundle of light rays which is substantially axially symmetrical to the optical axis 8. In front of the collecting lens 38, a biconcave cylindrical lens 40 is disposed which is hereinafter also referred to as a "dispersing trough" 40 and which is disposed in the cover plate or head 42 of the lighting fixture. This dispersing trough 40 is symmetrical to the vertical plane VK in which the optical axis 8 is disposed; in other words, the dispersing trough 40 extends perpendicularly to the horizontal plane EF of the drawing.

From FIG. 24, it is apparent that the dispersing trough 40 leaves the light collected by the axially symmetrical collecting lens 38 uninfluenced in the vertical plane (which is the plane of the drawing of FIG. 24), so that it extends over or covers the angular zone $\beta 1$ or $\beta 2$ or even $\beta 3$, respectively, in the vertical plane (see FIGS. 1 to 9), also after it leaves the dispersing trough 40. In the horizontal plane (FIG. 23), however, the dispersing trough 40 disperses the light to form a wide light fan, which can cover or extend over virtually 180°. A result thereof is that the entire horizontal angle $\gamma 1$ from the outermost light ray 44 of the second light radiation region or zone to the optical axis 8 is covered; $\gamma 1$ measures more than 110°.

Lateral light emanating or emergence openings (slots) according to the invention can also be produced by making the concave reflector of transparent material and in the region of the light emanating or emergence, no light emanating or emergence openings (slots) are provided, but rather, only the mirrored surface of the concave reflector has such an opening (slot) i.e. the mirroring or reflecting surface is omitted therefrom at that location.

It may also be of advantage to make the lighting fixture in the form of a sealed-beam lamp.

Figure 25:
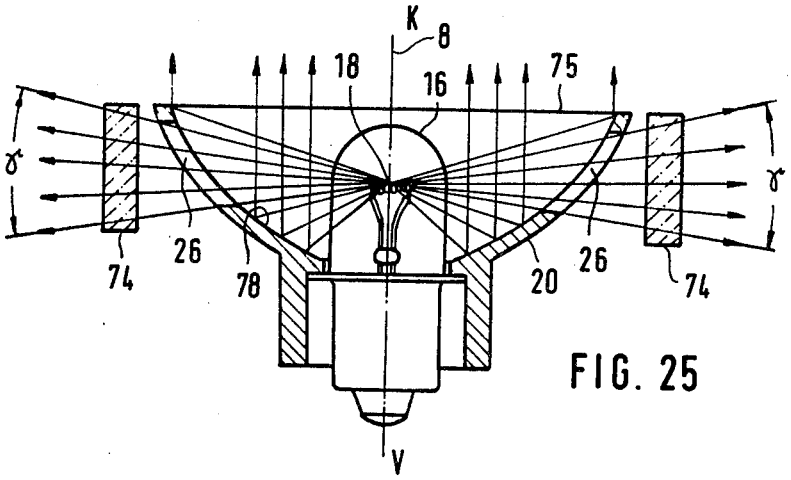
FIG. 25 is a horizontal cross-sectional view of a lighting fixture according to the invention having cylindrical or partly cylindrical collecting lenses.

FIG. 25 shows a lighting fixture, according to the invention, in horizontal cross section i.e. in the horizontal plane EF. In the reflector 20, two oppositely disposed slots 26 are disposed, in front of which two cylindrical collecting lenses or collecting-lens bars 74 are disposed.

Figure 27:
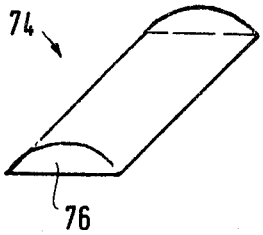
FIG. 27 is a perspective view of one of the cylindrical collecting lenses of FIGS. 25 and 26.

FIG. 27 shows a cylindrical collecting lens or collecting-lens bar 74 in perspective view. The cross section 76 of the collecting-lens bar 74 is plano-convex in this case, but it could also be biconvex or convex-concave, depending on what focusing and which focal lengths are required in the individual embodiments of the invention.

The light which, according to FIG. 25, falls from the luminous body 18 of the incandescent lamp 16 onto the mirrored inner surface 78 of the reflector, is focussed as the main light beam in the direction of the optical axis 8. The lateral light, which falls through the slots 26 onto the cylindrical collecting lenses or collecting-lens bars 74, passes through the latter in the horizontal plane EF (the plane of the drawing of FIG. 25) within the horizontal angle $\gamma$without changing direction, because the cylindrical collecting lenses or collecting-lens bars 74 are of equal thickness in the horizontal plane EF and therefore do not converge the light, so that the natural divergence of the light rays emanating from the luminous body 18 in the horizontal plane EF and planes parallel thereto is maintained. The slight parallel displacement or offset of this light is not shown in FIG. 25.

Figure 26:
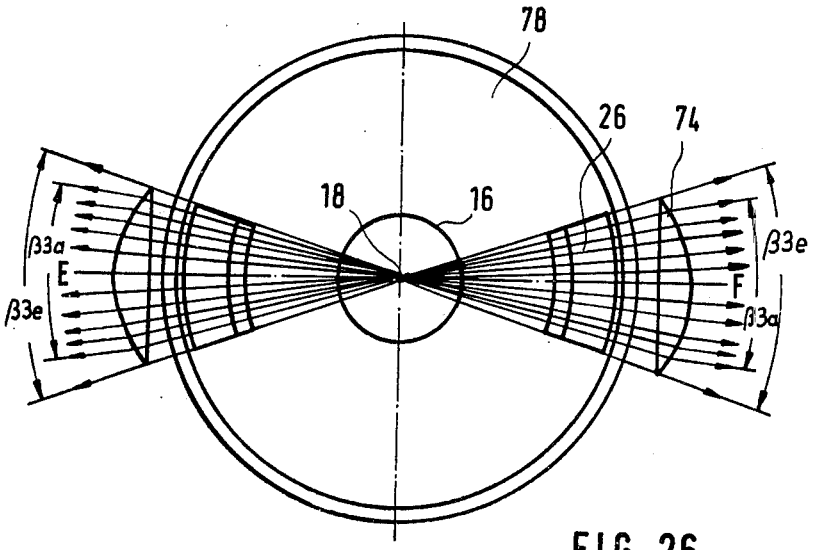
FIG. 26 is a top plan view of the lighting fixture of FIG. 25, which is in direction of the optical axis.

FIG. 26 is a view of the front light emanating or emergence opening 75 of the reflector 20 of FIG. 25. In the reflector, the slots 26 are shown, through which the lateral light falls on the plano-convex cylindrical collecting lenses or collecting-lens bars 74, which capture the light emanating directly from the luminous body 18 in the lateral light-accepting aperture angle $\beta 3e$, to collimate it into the aperture angle $\beta 3a$ of the light radiation in the direction toward the horizonal plane EF.

It is seen in FIG. 25 that the lateral light beams issuing on both sides lie in the same horizontal plane EF (plane of drawing of FIG. 25) as the main light beam. However, the lateral light beam forms in this horizontal plane with the optical axis 8 of the main light beam an angle of about 90°, the apex of which lies in the luminous body 18.

The lighting fixture shown in FIGS. 25 and 26 radiates a lateral light beam respectively to the right and the left-hand side and could be used as a tail light 6 or a parking light 10 in a bicycle 14 (FIGS. 4 to 9). In a motor vehicle 2 (FIGS. 1 to 3), on the other hand, it is sufficient if the lighting fixtures 4, 6, 10 and 12 emit a lateral light beam only to one side, either to the right or to the left-hand side. Such a lighting fixture is shown in FIG. 28 (a view in the direction of the optical axis) and FIG. 29 (a cross-sectional view taken along the horizontal plane EF, the plane of the drawing of FIG. 3). The view of FIG. 28 corresponds to that of FIG. 26, and the view of FIG. 29 to that of FIG. 25.

The concave reflector 20 has a mirrored inner surface 78 and is formed with a wedge-shaped slot 26. The edges 22 and 24 defining this wedge-shaped slot 26 allow the light emanating from the luminous body 18 of the incandescent lamp 16 to issue into a lateral light-accepting aperture angle $\beta 3e$ of about 90° and to fall onto a multistep cylindrical collecting lens 74*a* (FIG. 30), which collects this light into a lateral light-collecting aperture angle $\beta 3a$.

If a plano-convex cylindrical collecting lens 74 according to FIG. 27 were used, it would have the cylindrical surface 83 represented by the broken line as the convex boundary surface. Because of the larger lateral light-accepting aperture angle $\beta 3e$ of about 90°, the cylindrical collecting lens would be so thick that it would be difficult to manufacture because of the great increase in or accumulation of material. Therefore, in accordance with the invention, instead of the cylindrical surface 83, a multiplicity of narrow cylindrical surfaces 83*a*, 83*b*, 83*c* etc. is used, those surfaces being offset relative to each other and being connected to each other by step surfaces which are parallel to the emerging light, so that they are not in the way thereof. Such a cylindrical collecting lens, shown (in perspective) in FIG. 30 and (in cross-sectional view along the horizontal plane EF) in FIG. 31 is referred to hereinafter as "multistep cylindrical collecting lens". It is symmetrical to the horizontal plane EF, as is evident from FIG. 30.

The cylindrical collecting lens 74 or multistep cylindrical collecting lens 74a shown in FIGS. 27, 28, 30 and 31 is planoconvex. If constructed biconvex, the multistep cylindrical collecting lens would be formed with steps on both sides thereof. Such a symmetrical construction can make it possible to produce a multistep cylindrical collecting lens that is especially thin.

In order to obtain an especially strong lateral light, a spherical reflector shown at the top of FIGS. 28 and 29 is disposed opposite the slot 26 located on only one side of the lighting fixture.

In the horizontal cross-sectional view of FIG. 29, different radii R are shown, the common center for the circles or spheres of which lies in the luminous body 18 of the incandescent lamp 16. In its simplest embodiment, the spherical reflector would be a spherical surface with a radius R of one of the spheres. Advantageously, the spherical reflector should be constructed integrally with the concave reflector 20. To this end, the spherical reflector is formed of individual strips 85*a*, 85*b*, 85*c*, 85*d*, 85*e*, 85*f*, 85*g*, 85*h*, which are defined, according to FIG. 28, by circular arcs, according to FIG. 29, that are connected to each other by step surfaces. The step surfaces extend radially to the common center of curvature of the strips 85*a* to 85*h*, which lies in the luminous body 18. The spherical reflector which is formed by the strips 85*a* to 85*h* and is disposed in the surface of the concave reflector 20 is referred to hereinafter as a "multistep spherical reflector 85".

The light falling from the luminous body 18 onto the multistep spherical reflector 85 is reflected by the latter into the slot 26. On its way, it passes the region of the luminous body 18. In order that the latter should screen off as small a portion as possible of the light which is reflected by the multistep spherical reflector 85, the radii R are advantageously not connected exactly to one center but to a small sphere, in which the luminous body 18 occupies only a part; a result thereof is that the luminous body 18 screens off only a fraction of the light reflected by the multistep spherical reflector 85.

According to FIG. 28, the multistep spherical reflector 85 (as well as the slot 26) extend over a lateral angular range $\alpha$ of about 90° i.e. over about ¼ of the surface of the reflector 20, so that the intensity of the lateral light beam is virtually doubled by this multistep spherical reflector 85. For generating the main light beam, only two surface areas of the reflector 20, each of which extends over about 90°, remain in this embodiment of the invention i.e. only about one-half of the light which would otherwise fall on a complete reflector remains supplied to the main light beam. If this is insufficient, the lateral aperture angle $\beta 3e$, over which the multistep spherical reflector 85 extends, is reduced or this multistep spherical reflector 85 is omitted altogether, so that the metallized or mirrored inner surface 78 of the concave reflector 20, which produces the main light beam, becomes correspondingly larger.

FIGS. 32 to 37 diagrammatically illustrate a lighting fixture according to the invention, the two lateral cylindrical collecting lenses 74 of which are elongated in such a manner that they are joined together in front of the luminous body 18 to form a continuous cylindrical collecting lens. FIG. 32 is an axial cross-sectional view taken along the horizontal plane EF, FIG. 33 is an axial cross-sectional view taken along the vertical plane KV, FIGS. 34 and 35 are cross-sectional views of the lighting fixture of FIG. 32 taken along the lines I-I and II-II, respectively, and parallel to the plane of FIG. 33, and FIGS. 36 and 37 are cross-sectional views of the lighting fixture of FIG. 32 taken along the lines III-III and IV-IV, respectively, and perpendicular to the optical axis 8 of the reflector 20.

The reflecting areas of the concave reflector 20 eliminated by the presence of the slot 27 (FIG. 32) contribute nothing to producing the main light beam. According to the invention, the lateral cylindrical collecting lenses 74 are therefore joined together to form a single, curved cylindrical collecting lens 74 without reduction of the intensity of the main light beam. The advantages which accompany this lengthened cylindrical collecting lens which extends transversely in front of the forward light emanating or emergence opening 75 of the reflector 20 in the horizontal plane EF are explained hereinafter in detail with the aid of FIGS. 32 to 37:

FIG. 33 shows a lighting fixture according to the invention in a crosss-sectional view taken perpendicularly to the horizontal plane EF. The major part of the light falling from the luminous body 18 of the incandescent lamp 16 onto the mirrored or metallized inner surface 78 of the reflector 20 is collimated or collected into a main light beam, and a minor part of the light is gathered by the cylindrical collecting lens 74 in a light-accepting aperture angle $\beta$3e of about 60° and is collected into a smaller light-collecting aperture angle $\beta$3a of about 20° towards the horizontal plane EF and radiated. To an observer who is inside the light-collecting aperture angle $\beta$3a, the light will appear about three times as bright as without the cylindrical collecting lens.

The cylindrical collecting lens or collecting-lens bar 74 is disposed curved in the horizontal plane EF (FIG. 32) and forms a bead on the inside of the outside of the cover plate 42 (FIGS. 33 to 35); this bead merges into the cover plate 42 at an upper and a lower border line 70. The cylindrical collecting lens 74 should cover or extend over about the same aperture angle $\beta$3e of about 60° in all planes which are placed through the light center or concentration point of the luminous body 18 perpendicularly to the horizontal plane EF. For this reason, the cylindrical collecting lens 74 becomes wider with increasing distance from the luminous body 18. It is noticable that the cylindrical collecting lens 74 is substantially wider at the end faces 68 thereof than in the vicinity of the dome 86 of the incandescent bulb 16.

So that the light emanating from the luminous body 18 of the incandescent lamp 16 can strike the entire length and height of the cylindrical collecting lens 74, the edges 22 and 24 defining the two opposite wedge-shaped slots have a spacing from the base 28 to the forward light emanating or emergence aperture 75 that increases in such a manner that the lateral light is emitted through the slots with a lateral aperture angle $\beta$3e of 60° and is accepted by the cylindrical collecting lens 74. Since the light emanating from the luminous body 18 strikes the reflector normally all-around in an angular range or 360° in every plane perpendicular to the horizontal plane EF and extending through the light center or concentration point of the luminous body, between the base 28 and the light emanating or emergence aperture 75 of the reflector 20, due to the fact that the slots 26 in the instant case are respectively 60° wide as seen from the luminous body 18, $2\times60°=120°$ of a total of 360° are excepted from the collimation by the reflector. Only about $\frac{2}{3}$ of the light otherwise falling on the reflector 20 is collimated by the reflector 20 in the main light beam, while about $\frac{1}{3}$ of the light otherwise falling on the reflector 20 is emitted through the slots 26 towards the cylindrical collecting lens 74.

FIG. 32 is a cross-sectional view of FIG. 33 taken along the horizontal plane EF. Through the reflector aperture 75 and through the wedge-shaped slots 26 formed in the reflector 20, light falls on the entire length of the cylindrical collecting lens 74. In the horizontal plane EF and in all other horizontal planes, the light rays can pass through the cylindrical collecting lens 74 without any significant change in direction. Perpendicularly to the horizontal plane EF, the light rays accepted in an aperture angle $\beta$3e of about 60° are collimated into an aperture angle $\beta$3a of about 20° (see FIGS, 33, 36 and 37). This produces a light fan which, from the axis 8 of the main light beam to the end face 68 of the cylindrical collecting lens 74, covers or extends over a horizontal angle $\gamma$l of about 112° i.e. a total horizontal angle 2$\gamma$ l of about 224°.

FIGS. 34 and 35 are cross-sectional views of FIG. 32 parallel to the cross-sectional view of FIG. 33 and taken, respectively, along the lines I-I and II-II. The width z of the sectioned cylindrical collecting lens or collecting-lens bar 74 is smallest in FIG. 33, as it is closest there to the luminous body 18. In FIG. 34, the cross-sectional region (width z) thereof disposed in the cover plate 42 is appreciably wider and in FIG. 35 considerably wider (width z) in accordance with the increasing spacing from the luminous body 18 in order to be able to accept the light emanating from the luminous body 18 in the same aperture angle $\beta$3e of about 60°. The further shape of the cylindrical collecting lens 74 can be seen from FIGS. 33, 34 and 35 by the outer defining lines or contours 70 and the end faces 68 thereof.

The cross sections III-III and IV-IV, which are directed perpendicularly to the reflector axis 8 and are shown in FIGS. 36 and 37, intersect the cylindrical collecting lens 74 at a greater distance from the luminous body 18. In order to maintain the light-accepting aperture angle $\beta$3e (here, 60°) constant, the section of the cylindrical collecting lens 74 is wider in FIG. 36 than in FIG. 35, and is wider in FIG. 37 than in FIG. 36. The width z of the cylindrical collecting lens 74 therefore increases from the location of the cover plate 42, at which the optical axis 8 goes through the latter, toward the outside (corresponding to its increasing distance from the luminous body) in such a manner as is illustrated in FIGS. 33, 34, 35, 36 and 37.

The cylindrical collecting lens 74 shown in FIGS. 32 to 37 could also be biconvex at the dome of the cover plate 42 and then become plano-convex with increasing distance from the luminous body 76.

Figure 38:
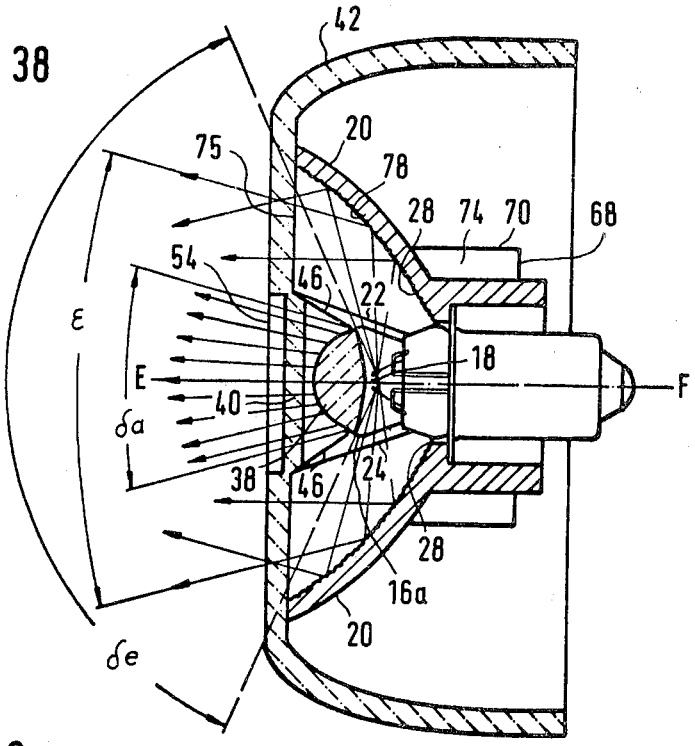
Figure 39:
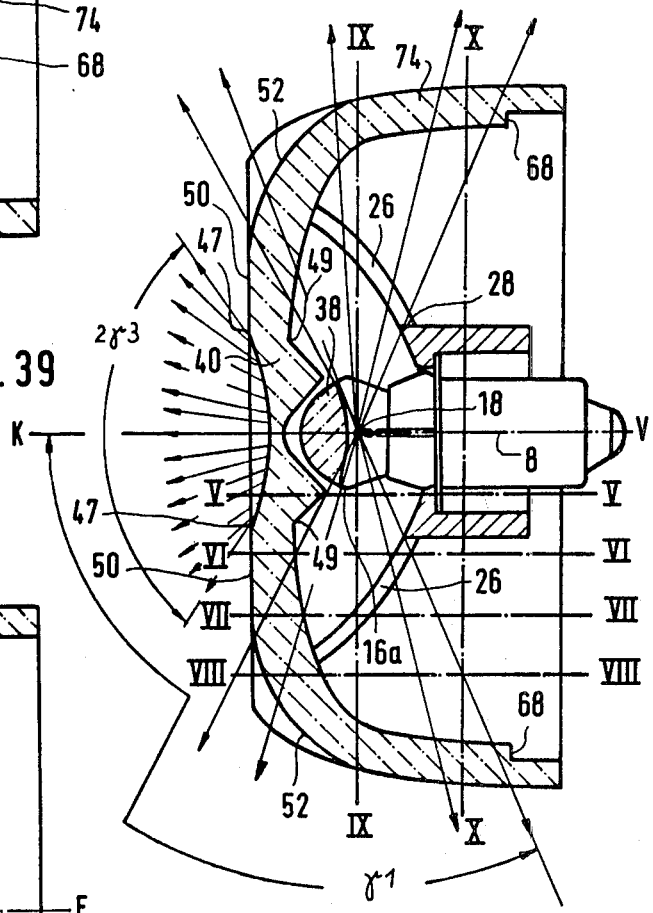

FIGS. 38 to 45 show a lighting fixture according to the invention with a lensend or lenticular lamp 16*a*, with cylindrical collecting lenses 74 and a "dispersing trough"40. FIG. 38 is an axial cross-sectional view taken perpendicularly to the horizontal plane EF, similar to that of FIG. 33, FIG. 39 is an axial cross-sectional view taken along the vertical plane KV and similar to that of FIG. 32, FIGS. 40, 41, 42 and 43 are cross-sectional views parallel to the plane of FIG. 38 of the light fixture of FIG. 39, taken along the lines V-V, VI-VI, VII-VII and VIII-VIII, respectively, and similar to those of FIGS. 34 and 35, and FIGS. 44 and 45 are cross-sectional views perpendicular to the optical axis 8 of the reflector 20 of the lighting fixture of FIG. 39 taken respectively along the lines IX-IX and X-X, and similar to those of FIGS. 36 and 37.

In FIGS. 38 to 45, similar parts are identified by the same reference characters as in the previous FIGS. 32 to 37. Reference can also be made to the description of the FIGS. 32 to 37, for an understanding of FIGS. 38 to 45, since the latter figures differ from the former figures by the lensend or lenticular lamp 16*a* and the dispersion trough 40 only.

According to FIGS. 38 and 39, a lensend lamp or bulb 16*a* is built into the lighting fixture in such a manner that the substantially axially-symmetrical collecting lens 38 thereof accepts the light emanating from the luminous body 18 in an axially-symmetrical acceptance angle $\delta$e of 130° and focusses it to a light beam with a collected or beam angle $\delta$a of about 30°. This focussed light passes through the biconcave cylindrical dispersing lens or "dispersing trough" 40. The latter is an integral part of the cover plate 42. The light falling on the mirrored inside 78 of the reflector 20 is radiated or collected in an aperture angle $\epsilon$ of about 30° (main light beam), which is axially-symmetrical to the axis 8 of the reflector 20. The reflector 20 has slots 26 which widen from the base 28 to the forward light emanating or emergence aperture 75. Due to the construction of the dispersing trough 40, which is explained with the aid of FIGS. 46 and 47, the light collected by the collecting lens 38 into a radiation angle $\delta a$ of about 30° (FIG. 38) is dispersed in the horizontal plane EF (FIG. 39) into a horizontal angle $2\gamma 3$ of about 110°. In planes perpendicular to the horizontal plane EF, on the other hand, the light collected or radiated by the collecting lens 38 is not influenced by the dispersing trough 40.

Figure 40:
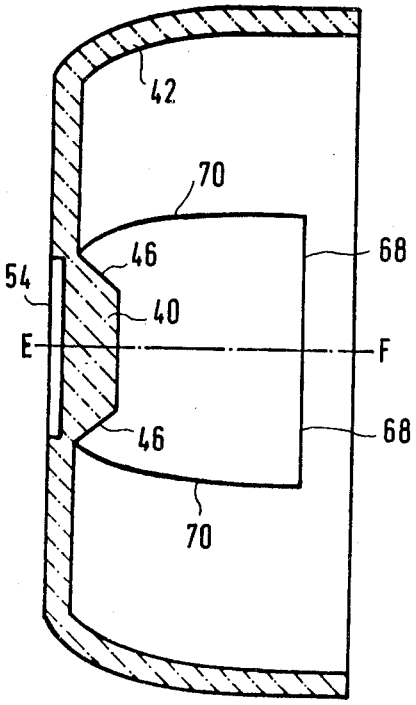

In FIGS. 38, 40 and 47, the inner edges 46 of the dispersing trough 40 can be seen.

On the outside, the dispersing trough 40 merges into the outer surfaces of the cylindrical collecting lens 74 at an outer border line 47 (FIGS. 39 and 46). On the inside, the dispersing trough 40 merges into the inside surfaces of the cylindrical collecting lens 74 at an inner border line 49 (FIGS. 39 and 47). Since, immediately next to the dispersing trough 40, the cylindrical collecting lens 74 cannot receive in the front region 50 thereof (FIG. 39) any light directly emanating from the luminous body 18 because of the shielding by the collecting lens 38, a gap could be left between the dispersing trough 40 and the cylindrical collecting lens 74. For reasons of injection-molding technology, however, it has been found advantageous if the dispersing trough 40 were to merge into the cylindrical collecting lens 74 in the described manner in an outside border line 47 and an inner border line 49.

The corner region 52 of the cylindrical collecting lens 74 protrudes into the wedge-shaped slots 26 in order to achieve a more uniform light distribution of the substantially horizontal light fan. This light fan extends from the optical axis 8 of the main light beam to the end face 68 of the cylindrical collecting lens 74 over a horizontal angle $\gamma l$ of about 115° i.e. the entire light beam extends in the horizontal plane EF, as seen from the luminous body 18, over a horizontal angle $2\gamma$ l of about 230°, whereas in contrast thereto, it extends perpendicularly to the horizontal plane EF over an aperture angle $\beta 3a$ of 20 to 30°.

FIGS. 38, 40, 41, 42 and 43 are parallel cross-sectional views perpendicular to the horizontal plane EF i.e. perpendicular to the plane of the drawing of FIG. 39, taken along the vertical plane KV or along the planes V-V, VI-VI, VII-VII and VIII-VIII (FIG. 39) which are parallel to the plane KV.

It is noted that the cross section of the cover plate 42 changes with increasing distance from the optical axis 8:

FIGS. 38 and 40 show the dispersing trough 40, the inner edges 46 as well as the outer cylindrical concave dispersing trough 54 which is shown in top plan view in FIG. 46.

Figure 41:
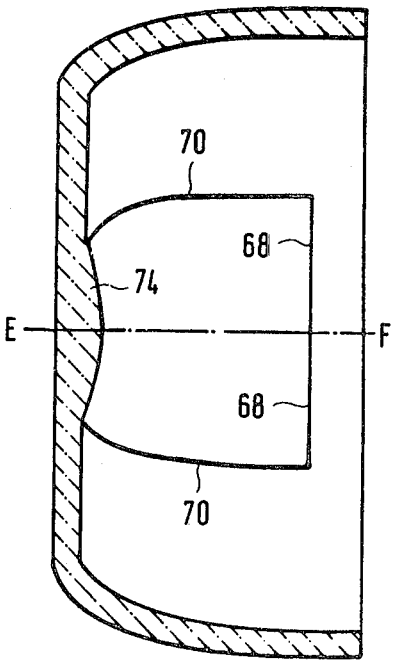

In the cross-sectional view of FIG. 41, taken along the line VI-VI in FIG. 39, the front surface of the cover plate 42 is not interrupted by the dispersing trough 54, but is planar. On the inside, the convex curvature of the cylindrical collecting lens 74 can be seen.

Figure 43:
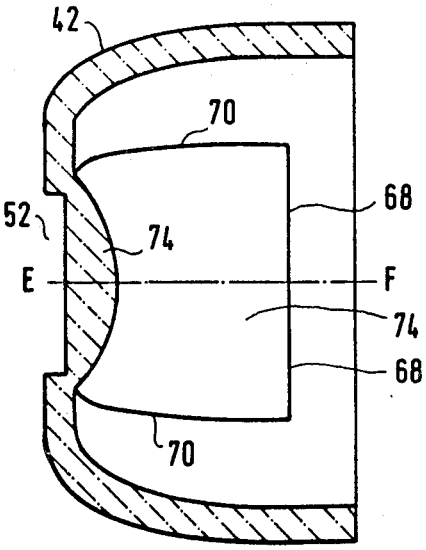
Figure 42:
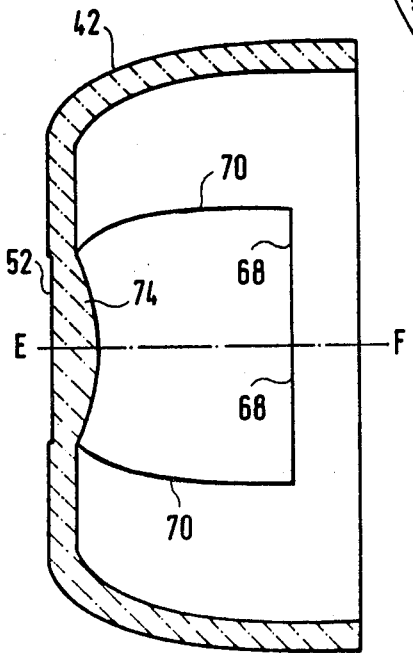

In FIG. 42 (cross section VII-VII of FIG. 39) and FIG. 43 (cross section VIII-VIII of FIG. 39), it is seen how the corner region 52 of the cylindrical collecting lens 74 recedes inwardly with increasing distance from the optical axis 8 of the reflector 20, so that the outer surface of the cover plate 42 there has a groove of rectangular cross section, the width of which is equal to that of the cylindrical collecting lens 74 and therewith increases toward the outside. In the corner region 52, the convex inside surface of the cylindrical collecting lens 74 projects on the inside of the cover plate 42 into the wedge-shaped slots 26 of the reflector 20.

By comparing FIGS. 41, 42 and 43, it is seen that the cylindrical collecting lens 74 becomes wider with increasing distance from the optical axis 8 of the reflector 20 i.e. toward the outside. A result thereof is that this cylindrical collecting lens 74 accepts the light emanating from the luminous body 18 in a uniform aperture angle $\beta 3e$, in this case, of about 42°.

Figure 44:
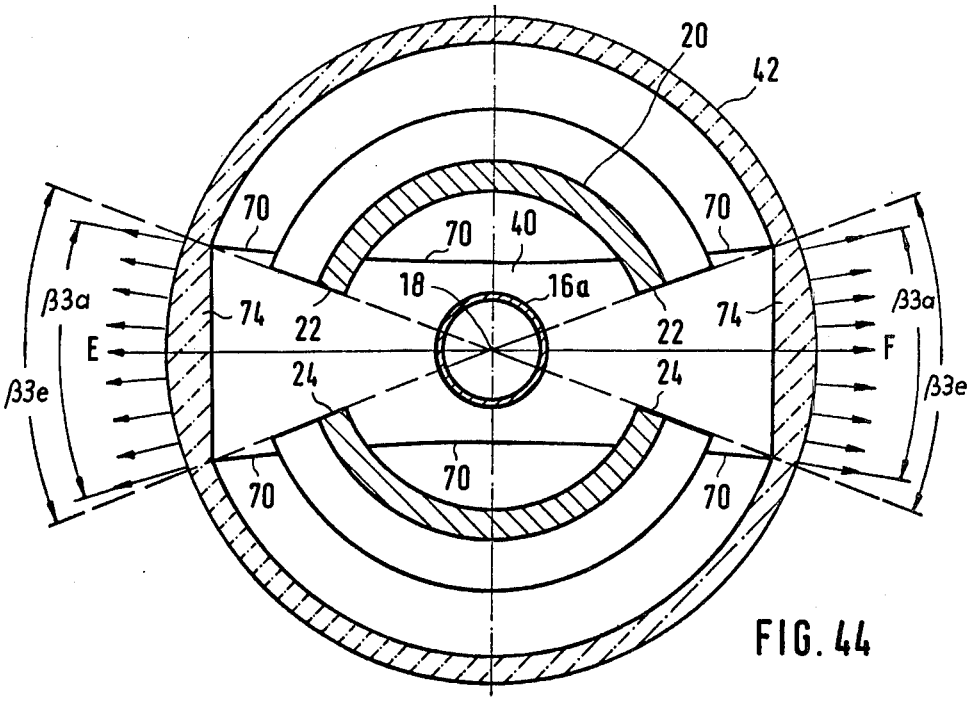
Figure 45:
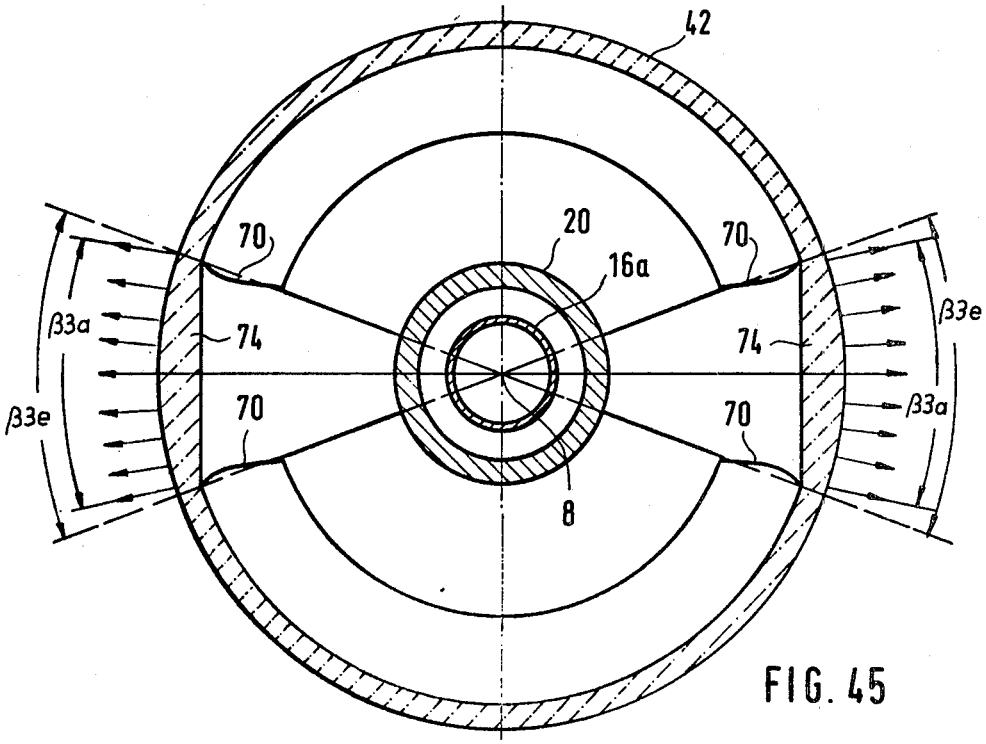

FIGS. 44 and 45, in the same manner as FIGS. 36 and 37, show a further increase in the width z (note FIGS. 34 and 35) of the cylindrical collecting lens 74, so that reference can be made at this point to the appertaining discussion with respect to FIGS. 36 and 37. The lateral light-accepting aperture angle $\beta 3e$ is 42° in the case of the embodiment of FIGS. 44 and 45, and the lateral light-collecting aperture angle $\beta 3a$ is 20°.

The cross-sectional plane IX-IX of FIG. 39 is illustrated in FIG. 44 and passes directly through the luminous body 18, whereas the luminous body 18 is located in front of the plane of the drawing of FIG. 45, so that the light therefrom does not fall perpendicularly on the cylindrical collecting lenses 74, but at the angle seen in FIG. 39.

The dispersing trough 40 is shown in FIG. 46 in a top view from the outside and in FIG. 47, in a bottom view from the inside of a lighting fixture constructed in accordance with the invention.

According to FIG. 46, the dispersing trough 40 is delineated from the rest of the outside surface of the cover plate 42 by an outer contour 47. Inside this circular bordering outline 47, parallel contour lines (which, like the contour lines of a map, have a given elevational distance from one another) indicate the distance of the outer surface of the dispersing trough 40 from the plane of the drawing. It is readily apparent that the spacing between the contour lines decreases toward both sides, corresponding to the increasing slope of this surface toward both sides, when the cylinder curvature is uniform as for FIG. 39. It is also apparent that the dispersing trough extends in a direction perpendicular to the horizontal plane EF.

FIG. 47 shows the dispersing trough 40 as seen from the inside i.e. in the direction of the travel of the light beam from the luminous body 18. The outer line 49 circularly delimits the dispersing trough 40 from the rest of the inside surface of the cover plate 42. This circular outline 49 is assumed to lie in the plane of the drawing of FIG. 47. The inner edge 46 (also visible in FIG. 38) projects from and in front of the plane of the drawing of FIG. 47. It defines a trough, the spacing of which outwardly or upwardly from the plane of the drawing of FIG. 47 is symbolized by contour lines in the same manner as in FIG. 46. It is apparent, by comparing FIGS. 46 and 47, that the thickness of the dispersing trough 40 increases in outward direction toward both sides from the symmetry line 51. Outside the inner outline edge 46, the surface of the dispersing trough 40, as is indicated by close spacing of the contour lines, drops to the plane of the drawing of FIG. 47 down to the circular outer border line 49.

The embodiment of the lighting fixture of FIGS. 48 to 50 differs considerably from the embodiments of the lighting fixture shown in the preceding figures by the fact that the cylindrical collecting lenses or multistep cylindrical collecting lenses are disposed only laterally and have no section extending perpendicularly to the optical axis 8 in front of the cover plate 42. Such a construction has been found to be particularly simple from the point of view of manufacturing technology.

In FIGS. 48 to 50, similar parts are identified by the same reference symbols or characters as in FIG. 39 corresponding to FIG. 48 and in FIG. 38 corresponding to FIG. 50. FIG. 49 is a top plan view of the cover plate 42. The axially symmetrical collecting lens 38 of the lensend or lenticular lamp 16*a* collects the light emanating from the luminous body 18 into a light beam which is dispersed in the horizontal plane EF into the dispersing angle $2\gamma 3$ through the dispersing trough 40 extending in front of the collecting lens 38. The concave reflector 20, in which the lensend or lenticular lamp 16*a* is disposed, collects the light into a non-illustrated main light beam which leaves the concave reflector 20 through the forward reflector aperture 75 in direction of the optical axis 8. This concave reflector 20 is formed with lateral slots 26, through which the light rays emanating from the luminous body 18 fall on the two lateral cylindrical collecting lenses 74 which are disposed in the horizontal plane EF only to the right-hand and left-hand sides of the optical axis 8. The two cylindrical collecting lenses 74, respectively form a light fan which laterally adjoins, to the right-hand or left-hand side, the light fan produced by the dispersing trough 40, and extends over a horizontal angle $\gamma$. Through suitable construction of the two cylindrical collecting lenses or collecting lens bars 74 and the dispersing trough 40, the outermost light ray 41, which is emitted by the dispersing trough 40, is substantially parallel to the innermost light ray 43, which is emitted by the two cylindrical collecting lenses 74; the light fan of the second light radiation zone then is non-interrupted or only slightly interrupted, since the parallel displacement of the rays 41 and 43 has no disturbing or disruptive effect. A continuous or only briefly interrupted light fan of $2\gamma 1=220°$ is produced in this embodiment.

FIG. 49, in a manner similar to that of FIG. 47, shows a top plan view of the embodiment of FIGS. 48 and 50 in direction of the optical axis 8. It is apparent therefrom that the reflector 20 has two oppositely disposed slots 26, through which the light emanating from the luminous body 18 falls onto the two lateral cylindrical collecting lenses 74 and into an aperture angle $\beta 3e$ of 50° and is collected and radiated threby into an aperture angle $\beta 3a$ of 20°.

All the lighting fixtures of the aforedescribed constructions can also be produced in the form of sealed-beam lamps, in which case the reflector is welded to the cover plate, the mirrored or metallized coating of the reflector being advantageously omitted in the region of the slots 26, so that the lateral light can pass through the transparent reflector material. In the vicinity of the slots 26, the wall of the reflector is constructed in this case, as a cylindrical collecting lens or multistep cylindrical collecting lens, in order to collect the lateral light toward the horizontal plane EF. Such a lighting fixture is illustrated in FIGS. 51 and 52, which correspond to FIGS. 33 and 32, respectively. Similar to FIG. 33, FIG. 51 is a sectional view perpendicular to the horizontal plane EF, whereas FIG. 52, corresponding to FIG. 32, is a sectional view taken alsng the horizontal plane EF.

The cover plate 42 of FIG. 51 carries a cylindrical collecting lens 74 or a multistep cylindrical collecting lens which, in this case, extends transversely over the entire cover plate 42 with constant width. The cover plate 42 is tightly fused at the rim 71 thereof to the reflector 20. The cylindrical collecting lens 74 or the multistep cylindrical collecting lens of the cover plate 42 is continued with constant width in lateral cylindrical collecting lenses which extend in front of the non-mirrored or non-metallized lateral light emanating or emergence regions of the reflector 20, which form slots, and are in direct contact with the reflector 20 on the outside, so that they are disposed at an inclination to the main axis. It is apparent in FIG. 51, that the edges 22 and 24 of the slots 26 are spaced at a constant distance from one another. The lateral aperture angle $\beta 3e$ covered by the light emanating from the luminous body 18 is consequently smaller, the greater the distance of the respective section of the cylindrical collecting lens 74 or the multistep cylindrical collecting lens from the luminous body 18. For this reason, the divergence of the accepted light is all the smaller, the greater the spacing from the luminous body 18 and, in order to attain a constant aperture angle $\beta 3a$ of the light fan, the collecting effect and, accordingly, the thickness of the cylindrical collecting lens 74 decreases with increasing distance or spacing of the respective section threof from the luminous body 18. This is apparent in FIG. 52 which is a cross-sectional view taken along the horizontal plane EF passing through the entire cylindrical collecting lens 74 or the multistep cylindrical collecting lens. It is readily noted that the thickness of the cylindrical collecting lens 74 or of the multistep cylindrical collecting lens is least in the region of the rim 71 of the lighting fixture, where the spacing from the luminous body 18 is greatest; the closer a respective region of the cylindrical collecting lens 74 is to the luminous body 18, the greater is the thickness thereof, and, consequently, the collecting action thereof.

Also in FIG. 52, can be seen the edges 22 and 24 of the slots 26 i.e. the non-mirrored or non-metallized areas or regions of the reflector. The light fan in the horizontal plane EF, which coincides with the plane of the drawing of FIG. 52, extends to both sides of the optical axis 8 over a respective horizontal angle $\gamma 1$, and over a total horizontal angle $2\gamma 1$.

If the lighting fixture according to the invention is used for a two-track vehicle, it would be sufficient to provide a non-mirrored area (slot 26) on only one side of the optical axis 8. The lateral light fan would then extend only on the one side of the axis 8 over the full horizontal angle $\gamma 1$, whereas it would only extend over the smaller horizontal angle $\gamma 2$ on the other side of the axis 8.

FIGS. 53 and 54 show in an axial, vertical sectional view and in a front elevational view, respectively, a lighting fixture assembly, according to the invention, having a lower lamp and an upper lamp (see FIG. 38).

In installed condition, the optical axis 8 of the upper lighting fixture subassembly should be horizontal. In this optical axis 8, a lensend lamp 16*a* is disposed in the base of a reflector 20 as in the case of the embodiment of FIG. 38. This reflector 20 is formed with lateral slots 26 which widen conically outwardly and can be seen more clearly in FIG. 54. FIG. 54 also shows the biconvex cylindrical collecting lenses 74, which accept the lateral light in the aperture angle β3e and which are constructed integrally with the wall of the housing 79 which encloses the two lighting fixture subassemblies. The cover plate 42 common to both lighting fixture subassemblies carries the dispersing trough 40 associated with the upper lamp according to the invention, as shown in FIG. 53. The transparent, colorless cover plate 42 is inserted into a transparent, yellow housing 79, for example. The light issuing from the front is therefore white and the lateral light yellow.

The construction of FIGS. 53 and 54 is based upon the following problem situation:

A bicyclist usually needs no frontward road illumination because the ambient brightness is usually so high, due to street lighting or moonlight, that at the bicyclist's relatively low velocity, he can see the road sufficiently well. Then, a position light in front which makes him recognizable to traffic coming from the front and from the sides, is sufficient. For this purpose i.e. to make the bicycle recognizable to other road users, a position light according to the invention is now available, which very sparingly uses the light generated by the lensend lamp or bulb 16*a* by collecting it into a fan which is narrowly confined in height but disperses widely in the horizontal plane EF. A weak lensend lamp or bulb 16*a*, which draws only very little current, can therefore be used. In the case of the bicyclist, the possibility of operating this forward or front position lamp with a battery 81 is afforded. If illumination of the road is required, then the lower lamp in the lighting fixture shown in FIGS. 53 and 54 is also switched on. This lower lighting fixture subassembly serves for the illumination of the road and is therefore inclined at an angle Ω with respect to the optical axis 8 of the upper position light, in accordance with the invention. The lower lamp has a stronger lensend lamp or bulb 16*a*, the power of which is adapted to the required road illumination, and which can be operated by battery or can be connected to a bicycle generator 80. This generator 80 is switched on, in addition, or is connected instead of the upper position light by the bicyclist if the ambient brightness is no longer sufficient for illuminating the road.

It is apparent that an exact adjustment of the optical axis 8*a* of the lower lamp is of decisive importance. If this lamp is set too high, the oncoming traffic is blinded; if it is set to low, the road illumination is inadequate. According to the invention, a spirit or bubble level 84 is therefore mounted on the housing. If the air bubble 87 is symmetrical to the mark 21, then both lighting fixtures are correctly adjusted.

The construction of FIGS. 55 and 56 has no optical collecting system for collecting the main light beam. As in FIG. 39, the cylindrical collecting lens 74 is disposed not only in the area or region of the lateral light, but also concentrically surrounds the luminous body 18 of the incandescent lamp 16. In this manner, as well as also by the joined-together cylindrical collecting lens of FIG. 39, a light fan of uniform intensity which has wide coverage and lies substantially in the horizontal plane EF and in planes parallel thereto is obtained. No main light beam produced by an optical collecting system such as the reflector 20 or axially symmetrical collecting lens 38 of the previously described embodiments is provided, but the intensity in the directions of the optical axis 8 (travel direction or opposite thereto) is as high as towards the side.

The intensity of this light fan is considerable, since the light emanating from the luminous body 18 can be accepted or gathered in a very large lateral aperture angle β3e and focussed toward the horizontal plane EF into the aperture angle β3a. A particularly large acceptance or gathering angle β3e is attainable if the cylindrical collecting lens 74 is constructed as a multistep cylindrical collecting lens 74*a* in accordance with FIGS. 28 to 31.

There is claimed:

1. Lighting fixture comprising an enclosure, means disposed in said enclosure for supplying a central source of light therein, a concave reflector for directing a main beam of light out of said enclosure from said source generally along a given optical axis, said concave collector having a light-penetrable region thereof disposed at least at one side of said optical axis in a common horizontal plane with said central light source and forming an escape window for part of the light from said source out of said enclosure.

2. Lighting fixture according to claim 1 wherein said light-penetrable region comprises at least one aperture formed in said concave reflector.

3. Lighting fixture according to claim 2 wherein said at least one aperture is located in said common horizontal plane on respective opposite sides of said optical axis.

4. Lighting fixture according to claim 2 wherein said at least one aperture constitutes at most 50% of the concave surface of the reflector that would otherwise be optically effective for reflecting the light.

5. Lighting fixture according to claim 2 wherein said aperture is formed as a slot defined by an upper and a lower edge in said reflector, said upper and said lower edges having a multiplicity of pairs of juxtaposed points, said pairs of points including with said central light source respective lateral aperture angles of substantially equal size.

6. Lighting fixture according to claim 5 wherein said concave reflector has a base at one end thereof and an outer rim at the other end thereof, said slot extending from said base to said outer rim.

7. Lighting fixture according to claim 5 wherein said concave reflector has a base at one end thereof and an outer rim at the other end thereof, said slot extending from a position substantially half-way between said base and said outer rim to said outer rim.

8. Lighting fixture according to claim 5 wherein said concave reflector has a base at one end thereof and an outer rim at the other end thereof, and said slot extends in direction from said outer rim toward said base and ends at a given location from which a line extending in said horizontal plane to said central light source defines a horizontal angle of at least 90° with said optical axis.

9. Lighting fixture according to claim 5 wherein said given optical axis is the optical axis of said reflector and said given optical axis is inclined at a given angle to said horizontal plane, said upper and lower edges of said slot defining with said central light source a lateral aperture angle having an angle bisector disposed in a plane which intersects in a common horizontal line with a vertical plane in which said given optical axis is disposed.

10. Lighting fixture according to claim 9 wherein said horizontal line extends through said central light source.

11. Lighting fixture according to claim 5 wherein said upper and lower edges of said slot define with said central light source a lateral aperture angle extending symmetrically to said horizontal plane, said lateral aperture angle being from 5° to 30°.

12. Lighting fixture according to claim 5 wherein said upper and lower edges of said slot define with said central light source a lateral aperture angle extending asymmetrically to said horizontal plane.

13. Lighting fixture according to claim 12 wherein said horizontal plane divides said lateral aperture angle into a relatively larger partial angle located above said horizontal plane and a relatively smaller partial angle located below said horizontal plane.

14. Lighting fixture according to claim 13 wherein said relatively larger partial angle is from 2° to 14°.

15. Lighting fixture accrding to claim 13 wherein said relatively smaller partial angle is from 1° to 7°.

16. Lighting fixture according to claim 2 wherein said concave reflector is formed of a base translucent material having a covering of reflective mirroring material, said aperture being a portion of said concave reflector at which said covering of reflective mirroring material is omitted from said base translucent material.

17. Lighting fixture according to claim 2 wherein said means for supplying a central light source comprises a luminous body, and including a collecting lens disposed in front of said luminous body, and an optical system in front of said collecting lens for scattering light in only two opposite directions in said horizontal plane.

18. Lighting fixture according to claim 17 wherein said light-scattering optical system comprises a concave cylindrical lens.

19. Lighting fixture according to claim 18 wherein said concave cylindrical lens extends perpendicularly to said horizontal plane.

20. Lighting fixture according to claim 18 wherein said concave cylindrical lens is thinnest in the middle thereof.

21. Lighting fixture according to claim 20 wherein said concave cylindrical lens is plane parallel, and extends monotonically and with increasing thickness from said middle thereof.

22. Lighting fixture according to claim 18 wherein said cylindrical lens is biconcave.

23. Lighting fixture according to claim 17 wherein said luminous body is located in a lensend incandescent lamp and said collecting lens is the lens at the end of said lensend incandescent lamp, said light-scattering optical system having means for diverging light radiated by said collecting lens from said incandescent lamp at a radiation angle into a horizontal scatter angle of at least 70°.

24. Lighting fixture according to claim 18 wherein said enclosure has a cover plate, and said concave cylindrical lens being an integral part of said cover plate.

25. Lighting fixture according to claim 5 wherein said means for supplying a central light source comprises a luminous body, and including an optical collecting system disposed in a light path extending from said luminous body and through said slot.

26. Lighting fixture according to claim 5 wherein said optical collecting system is disposed between said luminous body and said slot.

27. Lighting fixture according to claim 5 wherein said optical collecting system is disposed in said slot.

28. Lighting fixture according to claim 5 wherein said optical collecting system is disposed outside said reflector and in front of said slot.

29. Lighting fixture according to claim 25 wherein said optical collecting system comprises a cylindrical collecting lens disposed in said horizontal plane.

30. Lighting fixture according to claim 29 wherein said cylindrical collecting lens is symmetrical to said horizontal plane.

31. Lighting fixture according to claim 29 wherein said cylindrical collecting lens is disposed in said horizontal plane at one side of said optical axis, and another cylindrical collecting lens is disposed in said horizontal plane at an opposite side of said optical axis from said first-mentioned cylindrical collecting lens.

32. Lighting fixture according to claim 29 wherein said cylindrical collecting lens is a multistep cylindrical collecting lens.

33. Lighting fixture according to claim 29 wherein said cylindrical collecting lens is has means for accepting and radiating lateral light in said horizontal plane and in planes parallel thereto in a horizontal angle of at least 20°.

34. Lighting fixture according to claim 33 wherein said means for supplying a central light source comprises a lensend incandescent lamp having a collecting lens at the end thereof, and including an optical system in front of said collecting lens for scattering light in only two opposite directions in said horizontal plane, said optical system having means for diverging light radiated by said collecting lens of said incandescent lamp at a radiation angle into a horizontal scatter angle of at least 70°, said horizontal scatter angle and said horizontal angle wherein said cylindrical collecting lens accepts and radiates lateral light substantially adjoining one another, said horizontal scatter angle having a half-angle forming with said horizontal angle a combined horizontal angle equal to at least 90°.

35. Lighting fixture according to claim 31 wherein both of said cylindrical collecting lenses on opposite sides of said optical axis are elongated and mutually joined in front of said luminous body into one continuous cylindrical collecting lens extending over areas that are at best only slightly irradiated by said beam of light.

36. Lighting fixture according to claim 35 wherein said one continuous cylindrical collecting lens has means for accepting and radiating in longitudinal direction thereof the light from said luminous body, both in said horizontal plane and in planes parallel thereto, in an angular range of at least 180°.

37. Lighting fixture according to claim 25 wherein said optical collecting system has means for accepting the lateral light, in planes perpendicular to said horizontal plane, in a lateral aperture angle of at least 15° and for collecting said accepted lateral light toward said horizontal plane.

38. Lighting fixture according to claim 37 wherein said optical collecting system has means for radiating said accepted lateral light in planes perpendicular to said horizontal plane with a lateral aperture angle of the light radiation of between 5° to 50°.

39. Lighting fixture according to claim 38 wherein at least one of said lateral aperture angles, respectively, of the light radiation and of the light acceptance is symmetrical with respect to said horizontal plane.

40. Lighting fixture according to claim 37 wherein the lateral aperture angle of the light radiation extends asymmetrically with respect to said horizontal plane, the part of said lateral aperture angle located above said horizontal plane being larger than the part thereof located below said horizontal plane.

41. Lighting fixture according to claim 35 wherein said one continuous cylindrical collecting lens is curved so as to extend into said slot in said concave reflector.

42. Lighting fixture according to claim 29 wherein said enclosure has a cover plate, and said cylindrical collecting lens is an integral part of said cover plate.

43. Lighting fixture according to claim 1 wherein said enclosure is sealed in the form of a sealed-beam lighting fixture.

44. Lighting fixture according to claim 2 wherein said at least one aperture is formed as at least one slot in said concave reflector on only one side of said optical axis in said horizontal plane, and including a spherical reflector extending over an angular range and disposed between said central light source and said concave reflector on the other side of said optical axis and opposite said at least one slot whereby part of the light radiated directly from said light center and impinging on said spherical reflector is, in turn, radiated therefrom through said at least one slot.

45. Lighting fixture according to claim 44 wherein said spherical reflector is of multistep construction.

46. Lighting fixture according to claim 44 wherein said spherical reflector is disposed in a region of said concave reflector.

47. Lighting fixture according to claim 44 wherein said means for supplying a central light source comprise a luminous body, and said luminous body is received in an incandescent lamp, said spherical reflector forming an integral part of said incandescent lamp.

48. Lighting fixture assembly including a lighting ficture according to claim 2 and a second lighting fixture combined with the first-mentioned lighting fixture into a structural unit, said second lighting fixture having a concave reflector located substantially outside the concave reflector of the first-mentioned lighting fixture, said second lighting fixture having an optical axis disposed at an angle of between 2° to 6° to the optical axis of the first-mentioned lighting fixture, said optical axis of the first-mentioned lighting fixture, in installed condition of the lighting fixture assembly, being disposed in said horizontal plane, both of the lighting fixtures having respective incandescent lamps as means for supplying a source of light, the incandescent lamp of the first-mentioned lighting fixture having a smaller current drain than that of said second lighting fixture and serving as a position light, the incandescent lamp of said second lighting fixture having said optical axis thereof declining from said horizontal plane in said installed condition of the lighting fixture assembly and serving for illumination.

49. Lighting fixture assembly according to claim 48 including a common housing for the two lighting fixtures, and a spirit level mounted on said common housing.

50. Lighting fixture assembly according to claim 48 including means connectible to a battery for energizing the first-mentioned lighting fixture with battery current, and means selectively connectible to a battery and to a mechanical generator for energizing the second lighting fixture.

* * * * *